US005477719A

United States Patent [19]

Akiyama et al.

[11] Patent Number: 5,477,719

[45] Date of Patent: Dec. 26, 1995

[54] INCLINED-ROLLING METHOD AND INCLINED ROLLING APPARATUS

[75] Inventors: Masayoshi Akiyama, Kobe; Tomio Yamakawa, Kawanishi, both of Japan

[73] Assignee: Sumitomo Metal Industries, Ltd., Osaka, Japan

[21] Appl. No.: 288,961

[22] Filed: Aug. 10, 1994

Related U.S. Application Data

[63] Continuation-in-part of Ser. No. 996,160, Dec. 23, 1992, abandoned.

[30] Foreign Application Priority Data

Dec. 28, 1991 [JP] Japan ..... 3-359775
Apr. 3, 1992 [JP] Japan ..... 4-112153

[51] Int. Cl.[6] ..... B21B 19/04
[52] U.S. Cl. ..... 72/97
[58] Field of Search ..... 72/95, 96, 97, 72/100

[56] References Cited

U.S. PATENT DOCUMENTS 3,845,646 11/1974 Bellmann et al. .
4,470,282 9/1984 Hayashi .

FOREIGN PATENT DOCUMENTS 0156922 10/1985 European Pat. Off. .
2156595 5/1973 Germany .
63-90306 4/1988 Japan .
169110 7/1993 Japan ..... 72/97
428797 5/1974 U.S.S.R. ..... 72/96
2096505 10/1982 United Kingdom .

OTHER PUBLICATIONS

Hosokawa Tokio, "Tilt Type Rolling Method For Seamless Tube and Its Device", Japanese Patent Abstract, vol. 12, No. 321, Apr. 21, 1988.

*Primary Examiner*—Lowell A. Larson
*Attorney, Agent, or Firm*—Burns, Doane, Swecker & Mathis

[57] ABSTRACT

An inclined-rolling apparatus for piercing and rolling a tube material by the use of a pair of piercing rolls and a pair of disk rolls, wherein rolling operation is executed with the disk rolls being positioned such that a skew angle opposite to the revolving direction of the tube material is added to the outlet sides thereof and their shaft center lines are inclined. In order to get rid of the interference between the piercing rolls and the disk rolls, there is provided a circular groove at the periphery of a side face of each disk roll.

17 Claims, 23 Drawing Sheets

INCLINED-ROLLING METHOD AND INCLINED ROLLING APPARATUS

This is a continuation-in-part of Ser No. 07/996,160 filed Dec. 23, 1992, now abandoned.

BACKGROUND OF THE INVENTION

1. Field of the Invention

The present invention is regarding an inclined-rolling method for manufacturing pierced shells and similar products and an apparatus for use therewith.

2. Description of Related Art

FIG. 1 shows a rolling apparatus for forming tubes disclosed in Japanese Laid-Open Patent Application No. 63-90306. While being formed, a tube (not shown) is positioned between barrel rollers 110 and disc rollers 120 and is pierced by piercing mandrel 130. There exists an angle $\alpha_2$ between the axis of piercing mandrel 130 and the plane perpendicular to the rotation axes of disc rollers 120. The axes of disc rollers 120 lie in planes parallel to the axis of piercing mandrel 130.

FIGS. 2*a*, 2*b* and 3–6 show a rolling apparatus for rolling tubes disclosed in Japanese Laid-Open Patent Application No. 5-169110. In particular, FIG. 2*a* is a plan view showing an arrangement of a pair of piercing rolls in an inclined-rolling/piercing apparatus, and FIG. 2*b* is a cross section taken along the line II—II in FIG. 2*a* FIG. 3 is a plan view showing an outlet face angle α of each piercing roll without a feed angle being given. The pair of cone-shaped piercing rolls 1R, 1L are axisymmetrically disposed in such a manner that their axes respectively make a cross angle 7 to a pass center m.

The piercing rolls 1R, 1L are respectively inclined at a feed angle β, being in a twist positional relation. A plug 7 for piercing a billet 6 is so disposed between the piercing rolls 1R, 1L that its center axis corresponds to the pass center m, and its tip portion is located in the vicinity of the gorge portions of the piercing rolls 1R, 1L. The position of the plug 7 is held firmly by means of a mandrel which is placed onto a mandrel support device (not shown in the drawings ).

The piercing rolls 1R 1L are coupled to driving power sources 3R, 3L by means of driving shafts 2R, 2L respectively, so that the piercing rolls 1R, 1L rotate around their axes in the direction as shown in FIG. 2*a*. The revolutions of the piercing rolls 1R, 1L in the direction indicated by the arrow in FIG. 1 allow the billet 6 to be entangled in the piercing rolls 1R, 1L so that, the billet 6 is pierced while rotating around the pass center m clockwise when viewing from the outlet side. The billet 6 is accordingly pierced by the plug 7, while being pressed from both sides by the central portions of the piercing rolls 1R, 1L, whereby a pierced shell 9 is formed.

The billet 6 being thus pierced vibrates in the vertical plane because the piercing rolls 1R, 1L give work to the billet 6 from both sides. In order to prevent the vibration, the following attempt has been made: a pair of disk rolls are provided between the piercing rolls 1R, 1L so as to have the billet 6 therebetween (i.e., the disk rolls are aligned in the direction orthogonal to the plane of FIG. 2*a*).

FIG. 4 is a plan view showing the structure of the above-mentioned inclined-rolling/piercing apparatus, and FIG. 5 is an elevation of the apparatus shown in FIG. 4, when viewing from the outlet side. There are provided a pair of disk rolls 10U, 10D for preventing the vibration of the billet 6 from occurring, the disk rolls 10U, 10D being vertically symmetrically arranged with the billet 6 therebetween, in the vicinity of the piercing rolls 1R, 1L. The disk rolls 10U, 10D are in the form of a disk of which outer circumferential face is concaved, and are rotated about by the disk roll shafts 12U, 12D respectively in the rolling direction. This prevents the vibration of the billet 6 from occurring, and therefore the rolling operation is smoothly performed.

The above described apparatus, however, has a problem in that: since each off, the piercing rolls 1R, 1L has the outlet face angle α and makes the cross angle β to the pass center m, as pointed out above, during the time the piercing rolls 1R, 1L rotate and the billet 6 proceeds rotating around the pass center m, the metal of the pierced shell which is in contact with the surfaces of the disk rolls 10U, 10D is fed toward the gaps G1, G2 formed between the disk rolls 10U, 10D and the piercing rolls 1R, 1L, toward the same direction as the rotating direction of the billet 6, with the result that the metal is entrapped into the gaps G1, G2, thereby causing the peeling phenomena.

One proposal to solve this problem is disclosed in Japanese Patent Application Laid Open No. 5-169110 (1988). This teaches the following technique. FIG. 6 is a plan view showing the structure of the inclined-rolling/piercing apparatus disclosed in the above application. In FIG. 6, the parts indicated by the same reference ,numerals as used for those in FIGS. 4 and 5 are substantially identical to the latter. There are the piercing roll 1R on the right side and the piercing roll 1L on the left side to the outlet side for the billet 6, with their axes being in a twisted positional relation. The piercing roll 1R is inclined with its inlet side at an upper position and its outlet side at a lower position, while the piercing roll 1L is inclined with its inlet side and outlet side positioned in the opposite way.

More specifically, the disk roll 10U is positioned over the billet 6 whereas the disk roll 10D is under the billet 6 so that they are symmetrical with each other. The disk rolls 10U, 10D are so arranged that the angles formed by their respective side faces with respect to the pass line are equal to their respective Outlet face angles. The disk roll 10U has a skew angle of disk roll δ against the pass center m and, likewise, the disk roll 10D has a skew angle of disk roll δ in the opposite direction.

When the piercing rolls 1R, 1L are rotated in the direction indicated by the arrows in the drawing, the billet 6 is rolled, rotating clockwise when viewing from the outlet side. At that time, the disk rolls 10U, 10D prevent the metal from being caught into the gaps G1, G2, and therefore the entrapping of the metal can be avoided.

It has, however, turned out that when the billet 6 was pierced using such an inclined-rolling/piercing apparatus, the billet 6 was somewhat entrapped into the gaps G1, G2. Although the respective gaps look zero when viewing from above in the case where the disk rolls are arranged in parallel with the outlet faces of the piercing rolls, each piercing roll forms a feed angle β and therefore the practical gaps G1, G2 are not zero. In fact, the above-described method is based on the two-dimensional concept derived from viewing of the inclined-rolling/piercing apparatus from above.

SUMMARY OF THE. INVENTION

When the disk rolls 10U, 10D are arranged without a skew angle being added(see FIG. 4), the gaps G1, G2 into which the billet 6 will be forced and entrapped are the clearances defined between the disk rolls 10U, 10D and the piercing rolls 1R, 1L. This will be explained, taking the gap G1 defined between the piercing roll 1R and the disk roll 10U for example. Since the piercing roll 1R is inclined with the inlet side at an upper position and the outlet side at a lower position, the peripheral edge of the piercing roll 1R that forms an outlet face, angle is located lower than the disk roll 10U. This fact allows the skew angle for the disk roll 10U located at an upper position than that of the peripheral edge to be greater than the outlet face angle α. Further, the disk roll 10U is allowed to be closer to the piercing roll 1R than the case where the disk roll 10U is arranged in parallel with the outlet face of the piercing roll 1R.

One of the objects of the invention is to provide an inclined-rolling method and inclined-rolling apparatus that are capable of making the gaps between the piercing rolls and the disk rolls close to zero, thereby preventing the tube material from being entrapped into the gaps.

Another object of the invention is to provide an inclined-rolling method and inclined-rolling apparatus wherein the possible set range of the effective roll length, (i.e., the possible set range of the distance from the opposite gorge portion at which piercing/drawing is performed) can be made as wide as possible so that the amount of processing per unit length of the effective roll length can be reduced, thereby enabling a stable piercing operation for thin-wall materials.

A further object of the invention is to provide an inclined-rolling method and inclined-rolling apparatus that are capable of preventing the interference from occurring between the piercing rolls and the disk rolls, thereby making the gaps therebetween close to zero as much as possible.

According to the: invention, a tube material is rolled in such condition that the respective images of the shaft center lines of a pair of disk rolls projected on the plane which includes the roll shafts of a pair of piercing rolls to which no feed angle is given are not orthogonal (i.e. at an angle other than 90° ) to the pass line, and the respective shaft center lines intersect the plane. Such rolling using the piercing rolls and the disk rolls arranged as described: above enables the gaps between the piercing rolls and the disk rolls to be substantially zero, and therefore stable piercing/rolling operations can be performed.

Furthermore, each disk roll is provided with a circular groove at the peripheral edge of one side face thereof so that the side face can avoid contacting to the piercing roll. This arrangement enables the disk rolls to be inclined at a greater angle, thereby making the gaps between the piercing rolls and the disk rolls close to zero as much as possible.

The above and further objects and features of the invention will more fully be apparent from the following detailed description with accompanying drawings.

DESCRIPTION OF THE PREFERRED EMBODIMENTS

Figure 1:
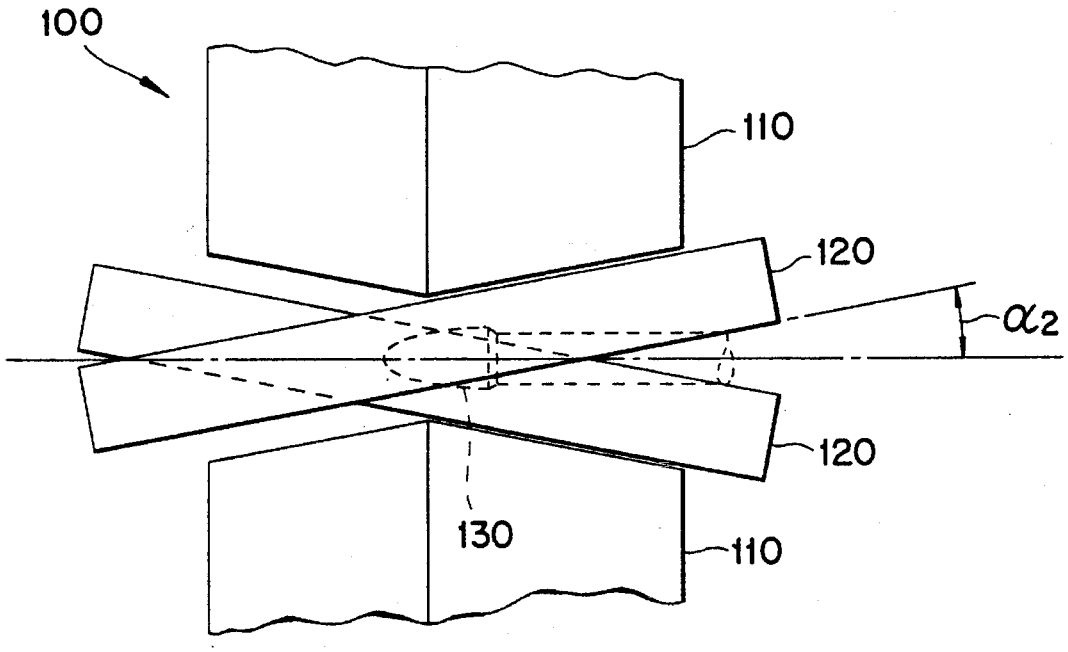
FIG. 1 is a plan view showing an arrangement of piercing rolls in a conventional inclined-rolling/piercing apparatus.

Referring now to the drawings, preferred embodiments of the invention will be described hereinbelow.

Figure 7:
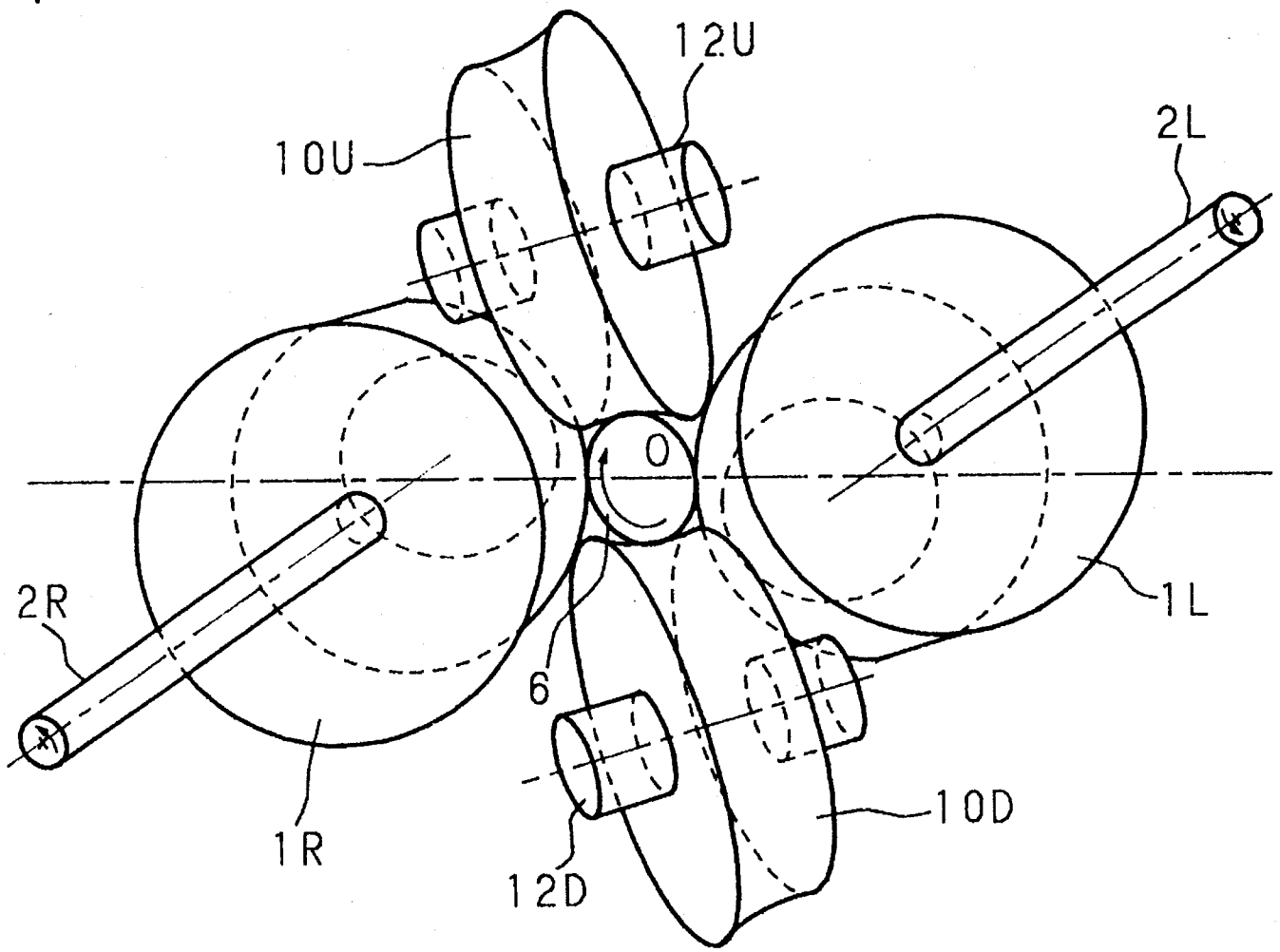
FIG. 7 is an elevation of an inclined-rolling/piercing apparatus according to the present invention when viewing from the outlet side.
Figure 8:
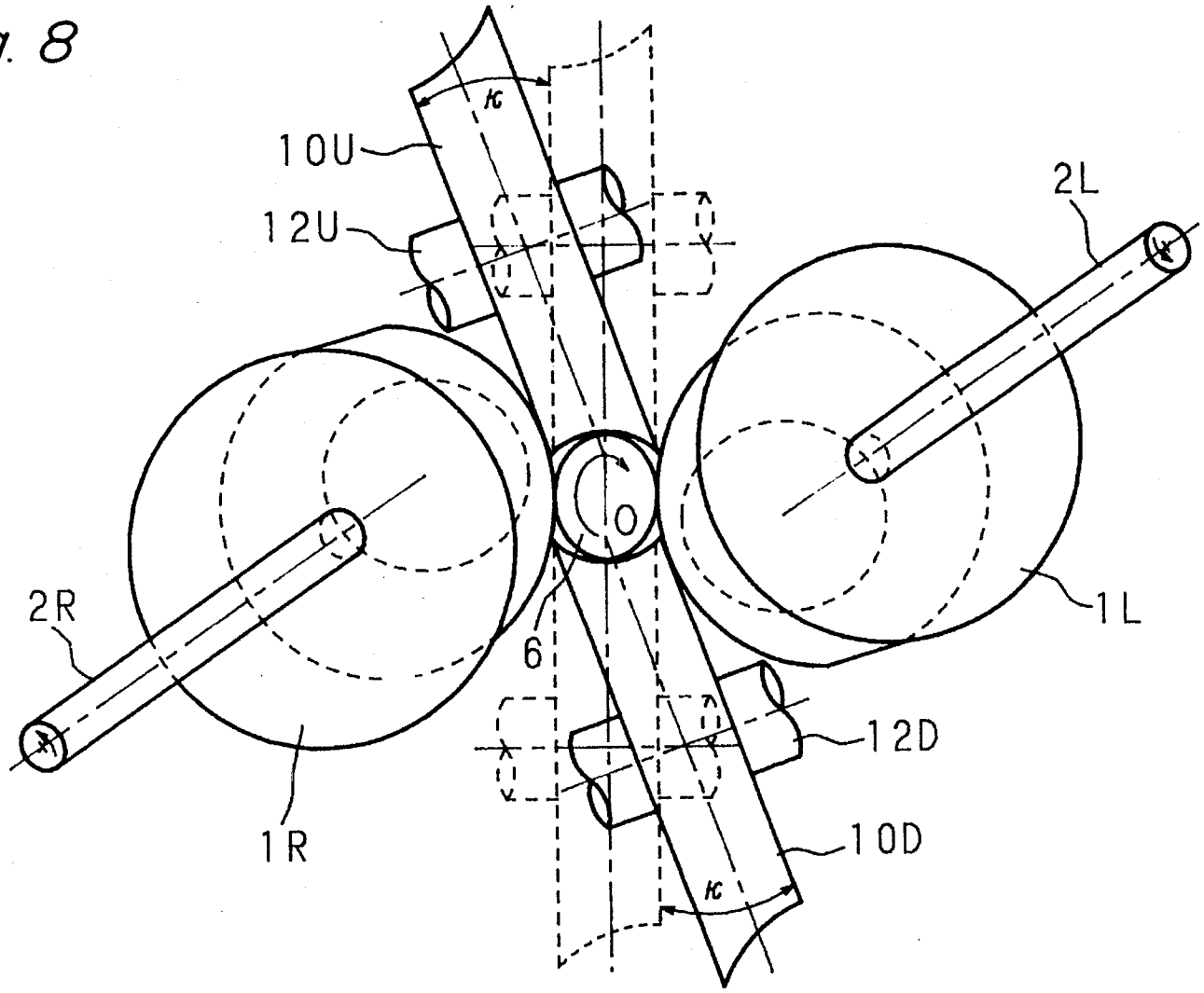
FIG. 8 is an elevation of the inclined-rolling/piercing apparatus to which an inclination angle of disk roll alone is given, when viewing from the outlet side.
Figure 9:
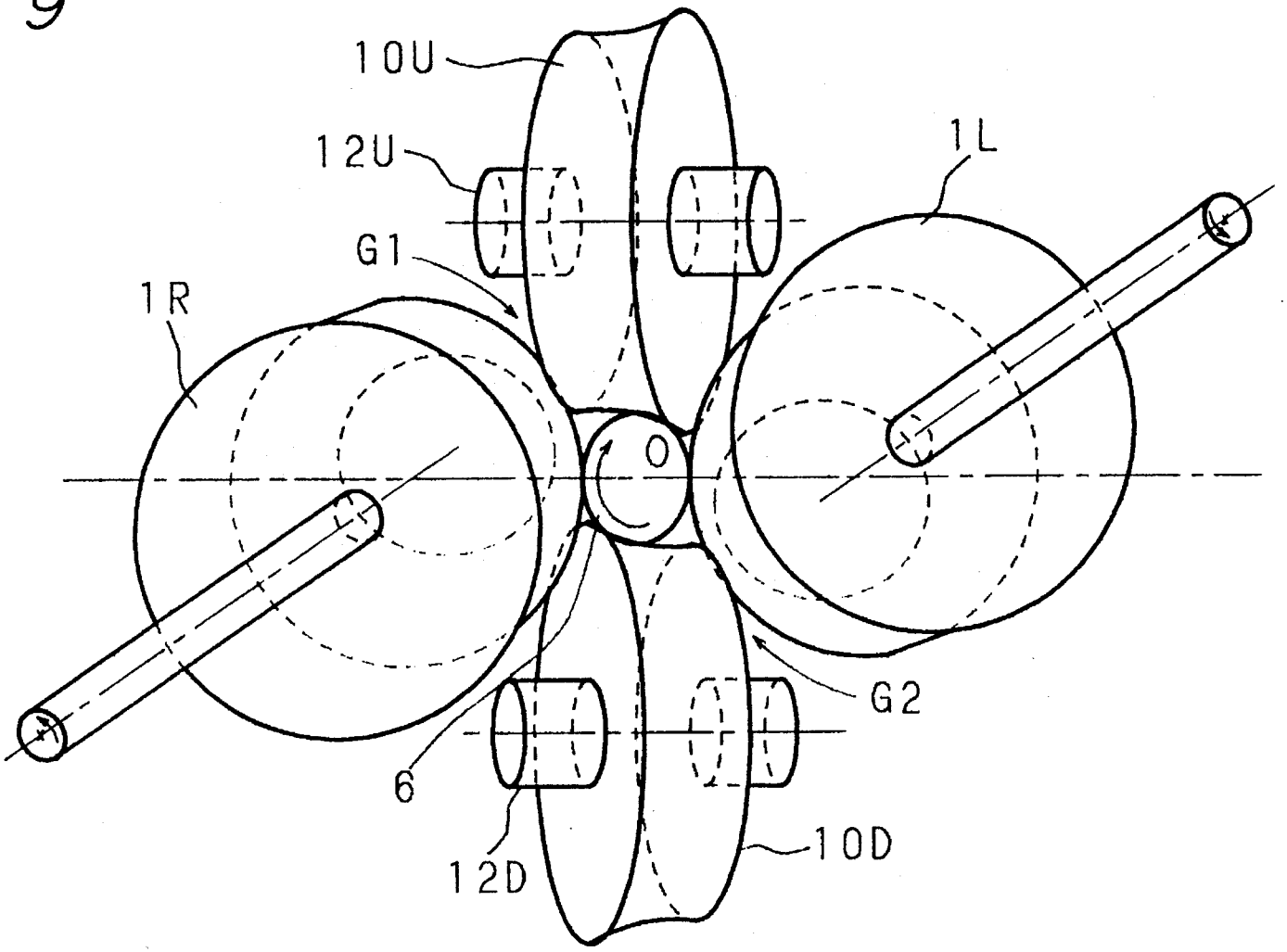
FIG. 9 is an elevation of the inclined-rolling/piercing apparatus to which a skew angle of disk roll alone is given, when viewing from the outlet side.

FIG. 7 is an elevation of an inclined-rolling/piercing apparatus according to the invention, when viewing from its outlet side. FIG. 8 is an elevation of the same apparatus to which an inclination angle of disk roll alone is given, and FIG. 9 is also an elevation of the same apparatus to which a skew angle of disk roll alone is given. In all these figures, the parts that are substantially equivalent to those in the examples of prior art are indicated by the same reference numerals as used for the latter.

Figure 2A:
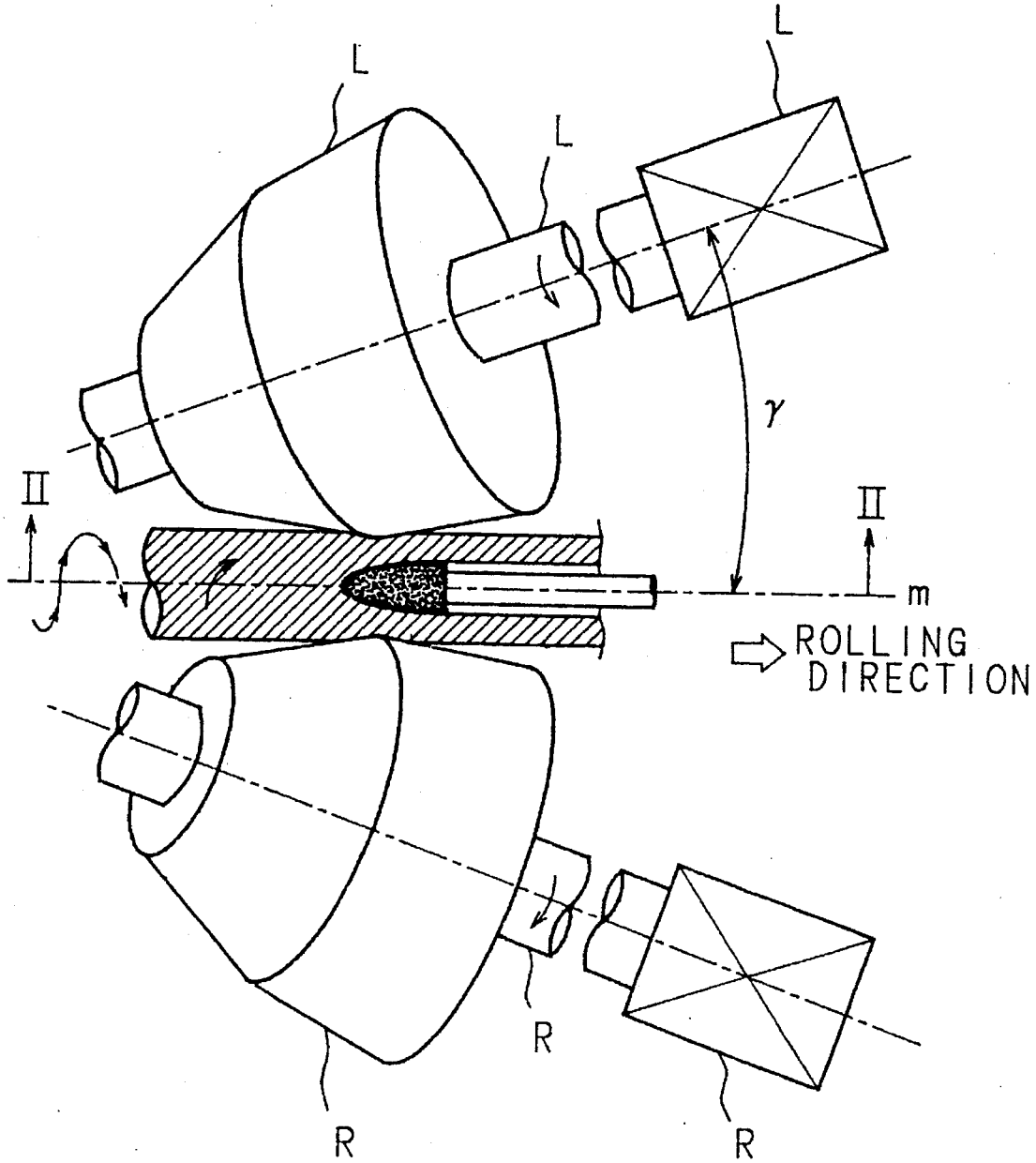
FIG. 2*a* shows an inclined-rolling/piercing apparatus and FIG. 2*b* is a cross section taken along the line II—II in FIG. 2*a;*
Figure 2B:
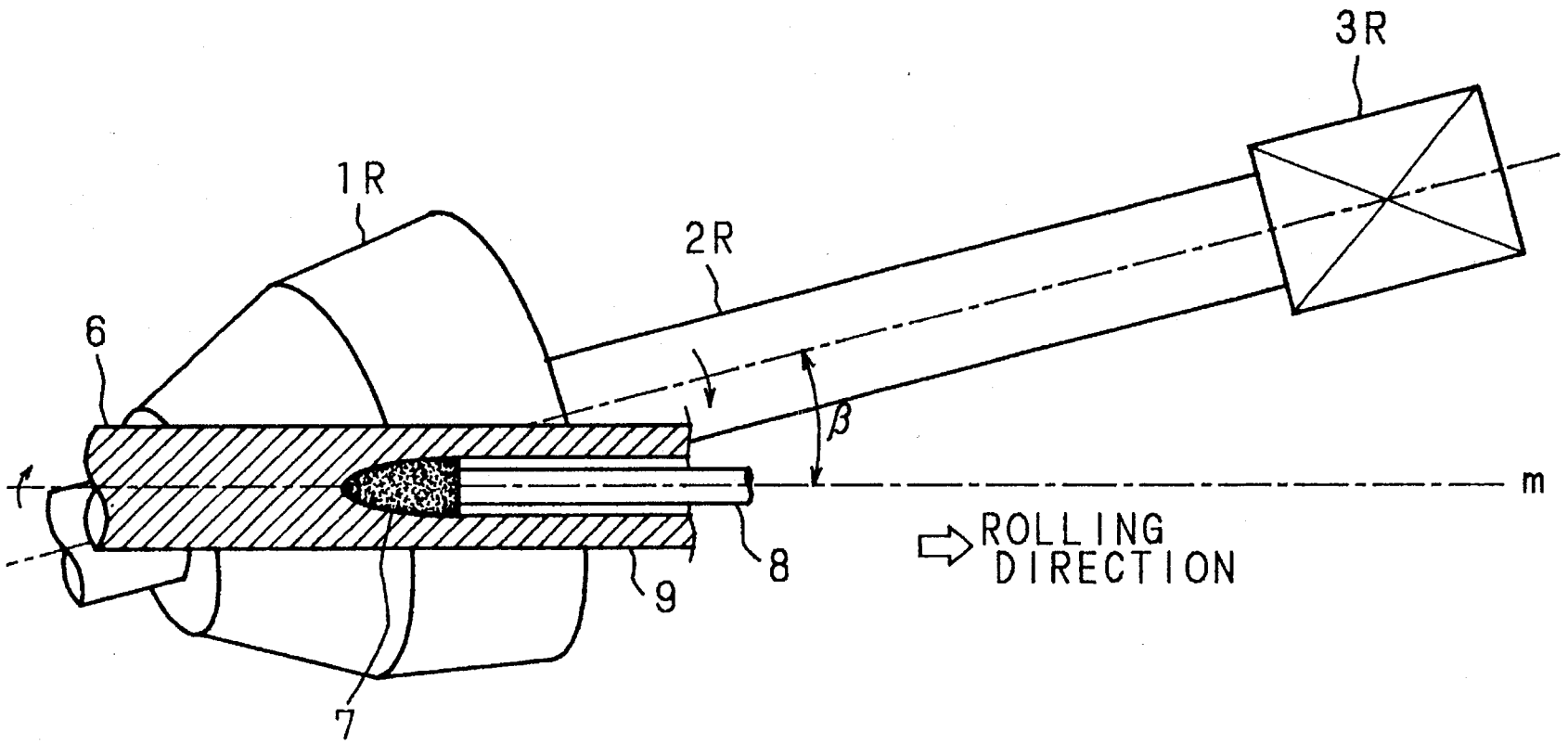
Figure 3:
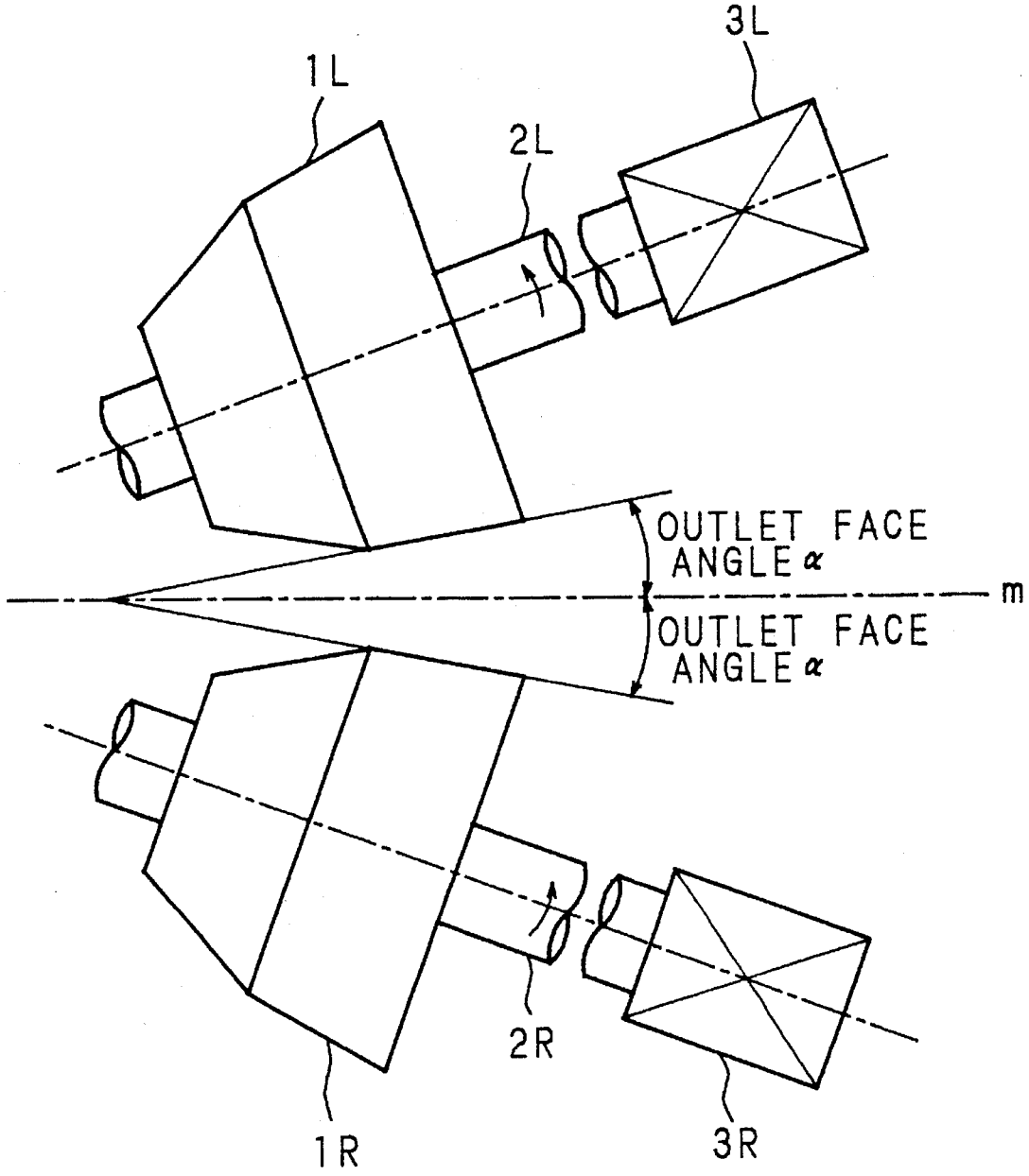
FIG. 3 is a plan view showing the respective outlet face angles of piercing rolls to which no feed angle is given.
Figure 4:
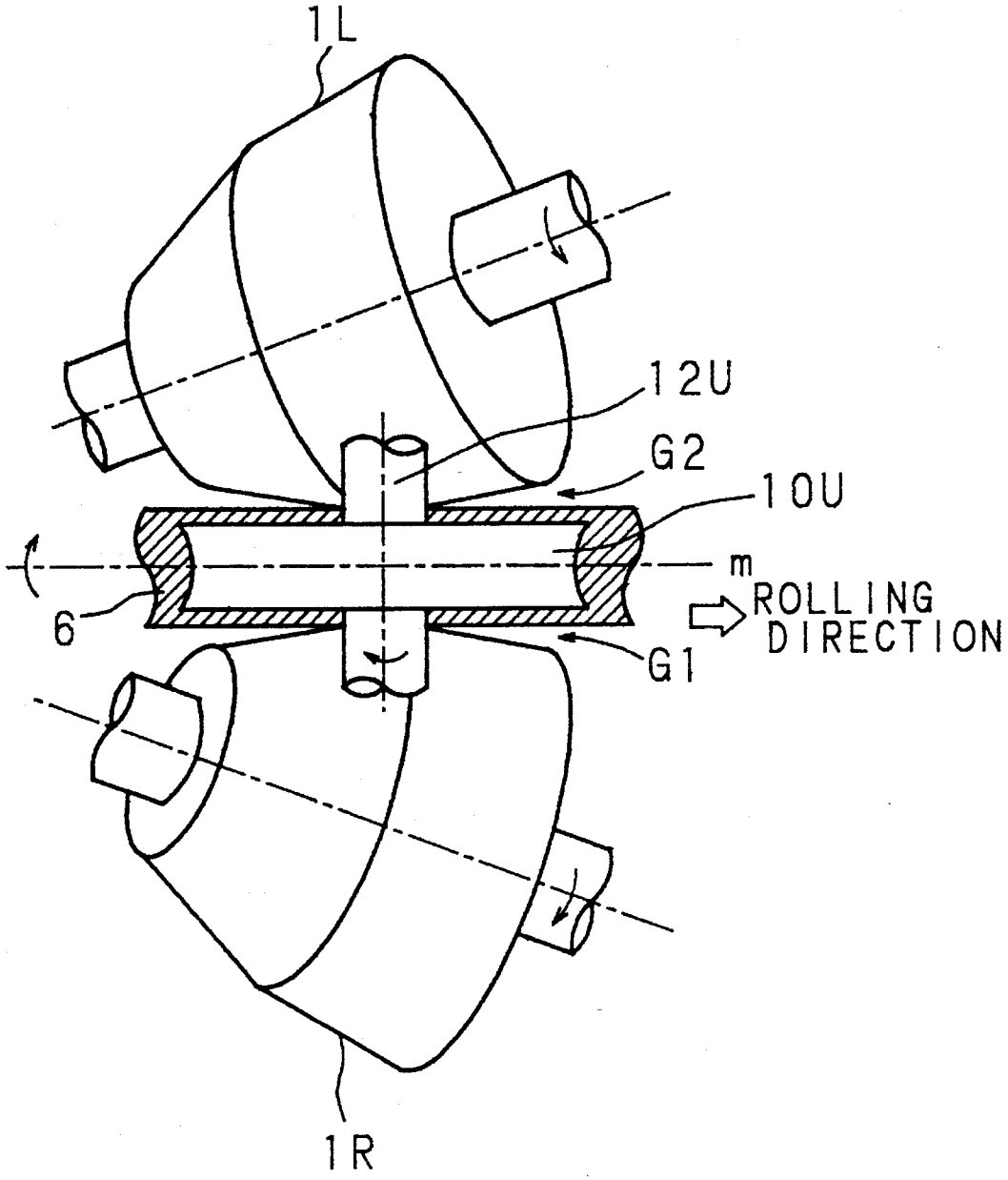
FIG. 4 is a plan view showing an arrangement of piercing rolls and disk rolls in a conventional inclined-rolling/piercing apparatus
Figure 5:
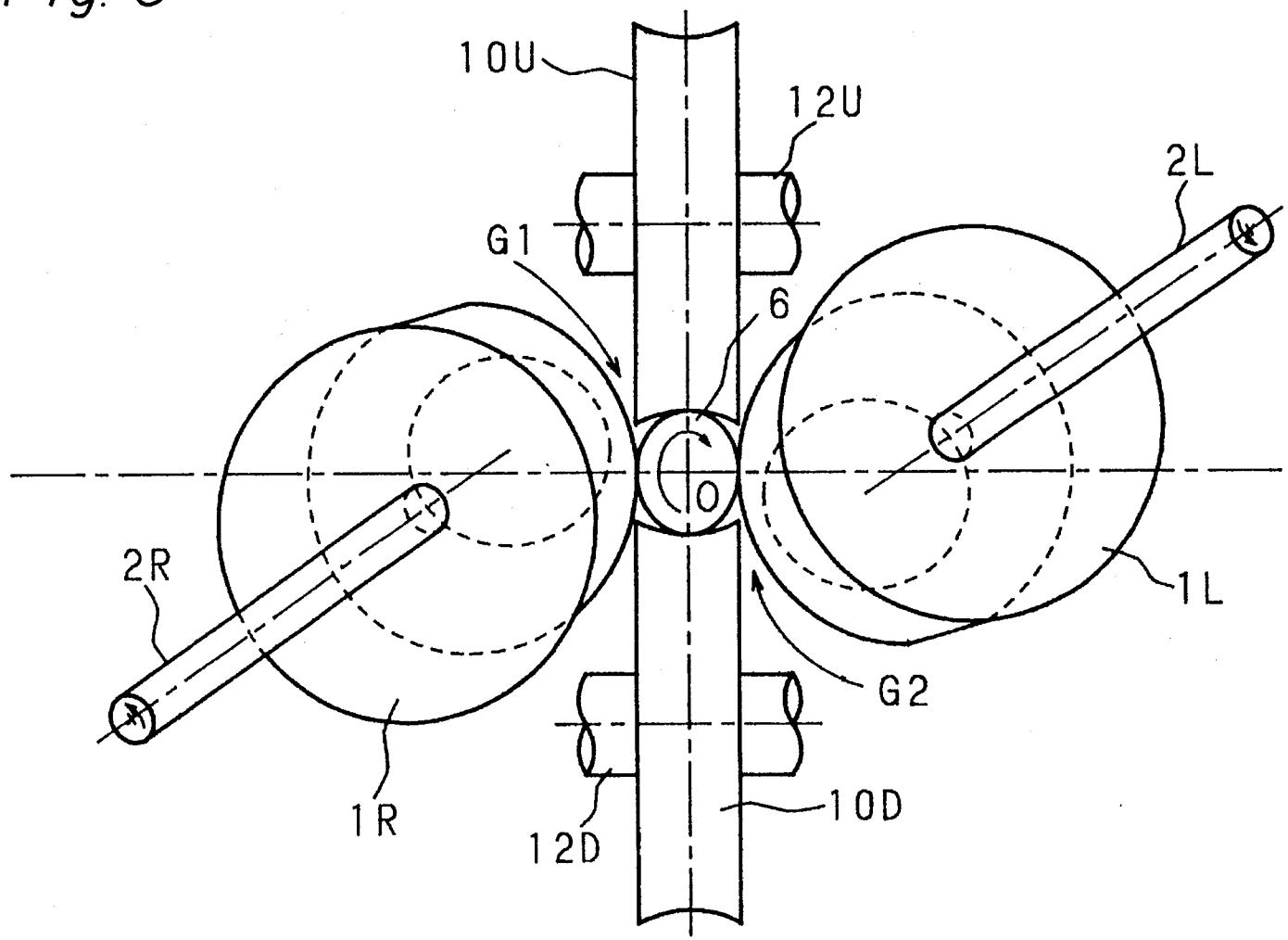
FIG. 5 is an elevation of the conventional inclined-rolling/piercing apparatus when viewing from the outlet side.

Similarly to the prior art, there are provided the pair of piercing rolls 1R, 1L which are respectively placed at the feed angle β. The piercing rolls 1R, 1L are axisymmetrically arranged With their axes each forming the cross angle γ to the pass center m (see FIGS. 2*a* and 2*b*). Their outlet face angles are represented by α (see FIG. 3). The disk rolls 10U, 10D, each of which has different edge diameters on the right and left, are respectively disposed over and under the billet 6 to be pierced. Specifically, the disk roll 10U is located over the billet 6 with its edge of a smaller diameter on the side of the piercing roll IR while the disk roll 10D is under the billet 6 with its edge of a smaller diameter on the side of the piercing roll 1L, so that at the upper stream of the rotation of the billet 6 is provided to the smaller diameter edge and at the lower stream of the rotation of the billet 6 is provided to the larger-diameter edge. Alternatively, the arrangement may be made, unlike the above, embodiment, such that the smaller-diameter edge of the disk roll 10U is on the side of the piercing roll 1L and the smaller-diameter edge of the disk roll 10D is on the side of the piercing roll 1R. In addition, the disk rolls 10U, 110D may be respectively formed such that both edges have the same diameter.

As shown in FIG. 8, the disk roll 10U is inclined at an angle of κ (inclination angle of disk roll) towards the piercing roll 1R. Likewise, the disk roll 10D is inclined at κ towards the piercing roll IL.

Figure 6:
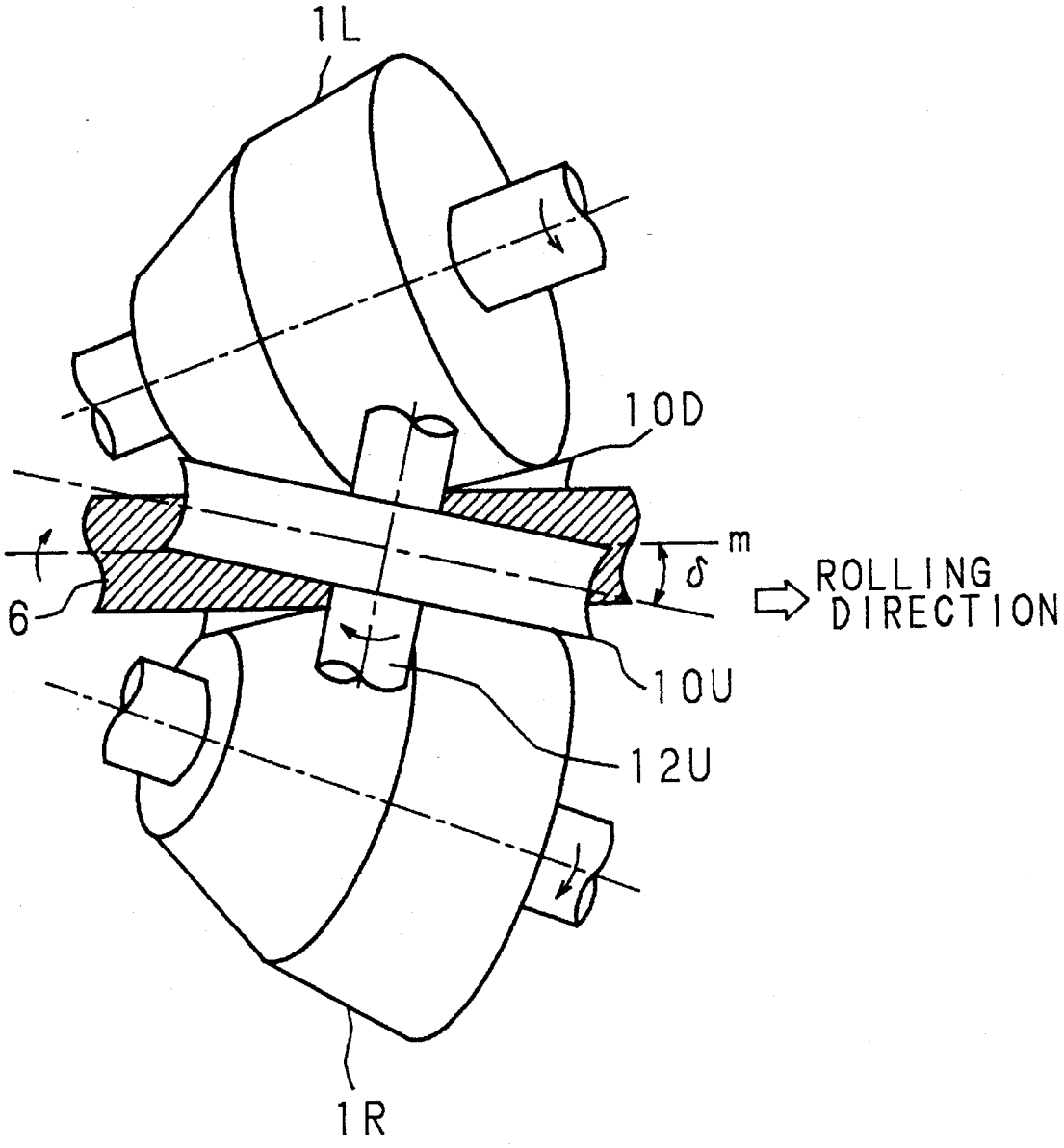
FIG. 6 is a plan view showing an arrangement of piercing rolls and disk rolls in a conventional inclined-rolling/piercing apparatus

As shown in FIG. 6, the disk roll shafts are arranged horizontally with respect to the center of the disk rolls and a skew angle of disk roll δ is given to make the disk rolls inclined at their outlet side in a direction opposite to the rotating direction of the billet 6.

High efficiency of inclined-rolling/piercing apparatus as shown in FIG. 7 can be achieved by adding the inclination angle of disk roll κ and the skew angle of disk roll δ.

In the case where the piercing rolls 1R, 1L rotate in the direction indicated in FIG. 7, the billet 6 to be pierced is rolled while rotating around O in a clockwise direction when viewing from the outlet side. The billet 6 is pierced by a plug, while being pressed from both sides by the gorge portions of the piercing rolls 1R, 1L. In this way, a pierced shell is formed. This rolling operation is the same as that of the prior art.

Examples in which piercing is carried out using the above-described apparatus will be hereinafter described with concrete numeric values.

Piercing rolls having a gorge diameter of 410 mm were arranged under the following conditions: the outlet face angle α=4° , the feed angle β =12° , and the space between the opposite gorge portions=62 mm. Disk rolls having a disk edge diameter of 1,200 mm (on the upper stream side of the rotation of the billet) were spaced 35 mm (disk edge half spacing) apart. In each of the cases where the cross angle γ=10° and Where the cross angle γ=30°, the skew angle of disk of roll δ was varied to 0°, 2°, 4° and 6°. Then, with the inclination angle of disk roll being varied to 0°, 10° and a maximum inclination angle $\kappa_m$, the billet 6 was pierced in each case so as to have an outer diameter of 90 mm and a wall thickness of 2 mm. Note that the maximum inclination angle $\delta_m$ m is specified by the value κ of a limit beyond which the disk roll is brought into physical contact with the side face of the piercing roll. Accordingly, piercing was carried out and the distance from the opposite gorge portion to the position at which the gap GI(G2) exceeds 2 mm was measured in each case. The results are shown in Table 1.

TABLE 1

| | | (unit/mm) .lh8 | | |
|---|---|---|---|---|
| γ | δ | κ = 0° | κ = 10° | κ = $\kappa_m$ |
| 10° | 0° | 23 | 25 | 33($\kappa_m$ = 15°) |
| | 2° | 32 | 34 | 38($\kappa_m$ = 15°) |
| | 4° | 50 | 55 | 66($\kappa_m$ = 15°) |
| | 6° | 86 | 115 | 134($\kappa_m$ = 14°) |
| 30° | 0° | 25 | 28 | 28($\kappa_m$ = 13°) |
| | 2° | 34 | 38 | 38($\kappa_m$ = 13°) |
| | 4° | 60 | 75 | 90($\kappa_m$ = 13°) |
| | 6° | 160 | 190 | 190($\kappa_m$ = 10°) |

In the case that a pierced shell having a wall thickness of 2 mm is formed, the entrapping of metal takes place when the gaps G1, G2 are 2 mm or more. Therefore, the above distance is equal to the distance from the opposite gorge portion after the plug 7 has started to pierce the billet 6 until the formation of a pierced shell is completed, i.e., the possible set range of the effective roll length. As the effective roll length is shorter, the amount of processing per unit effective roll length becomes larger and the load on the billet 6 increases so that stable rolling/piercing operation cannot be easily performed.

It is understood from the results shown in Table 1 that with the skew angle of disk roll δ being fixed, the greater the inclination angle of disk roll κ, the wider the possible set range of the effective roll length. However, when κ is too large, the disk rolls come into contact with the piercing rolls, and therefore the inclination angle of disk roll κ is preferably not more than 20°.

The greater the skew angle of disk roll δ, the wider the possible set range of the effective roll length, and the greater effects can be obtainable by adding the skew angle of disk roll δ that is not less than the outlet face angle α (=4°). However, it should be noted that when α is too large, the disk rolls come in contact with the piercing rolls, and therefore the preferable skew angle of disk roll δ is not more than 1.5 times the outlet face angle α (see FIG. 3) of the piercing roll.

The greater the cross angle γ, the wider the possible set range of the effective roll length. By increasing the cross angle γ with the outlet face angle α fixed, the gorge diameter and their outlet diameter of the piercing roll can be increased so that the outlet face of the piercing roll becomes closer to a flat surface. Since the gap becomes more unlikely to expand towards the outlet as the outlet face is closer to a flat surface, the possible set range of the effective roll length can be made wider. Practical considerations of the diameter of the piercing roll require that y should be approximately in the range of 5° to 30°.

It is also understood that the piercing result (i.e., 75 mm) of the case where the cross angle γ is 30°, the skew angle of disk roll δ is 4° and the inclination angle of disk roll κ is 10° is much higher than the value obtained by simply adding 3 mm (=28–25 mm) (this value represents the effect which can be expected when only the inclination angle of disk roll κ=10° is added.) to the result (i.e., 60 mm) of the case where only the skew angle of disk roll δ=4° is added. A great effect which cannot be expected by a simple algebraic addition is obtainable particularly when the skew angle of disk roll δ is not less than the outlet face angle α. It is obvious from the above fact that multiple effects for preventing the entrapping of the billet from occurring can be expected by giving both the skew angle of disk roll δ and the inclination angle of disk roll κ.

The wall thickness/outer diameter ratio in this embodiment is approximately 2.2% which is a considerable improvement over the limit ratio of thin-wall tubes (=3.6%) disclosed in "Developments in the Field of Piercing Billets for Seamless Tubemaking" (TPT-USA, March–April, 1991 p.20– p.32). The wall-thickness has been improved by 39% (2.2÷ 3.6=0.61) by this embodiment.

Now, there will be explained a mechanism for giving the skew angle of disk roll δ and tile inclination angle of disk roll κ. By the use of the same mechanism, the skew angle δ and the inclination angle κ can be given to both the upper disk roll 10U and the lower disk roll 10D, and therefore the following description will be based on only the case where the skew angle δ and the inclination angle κ are given to the upper disk roll 10U.

Figure 10:
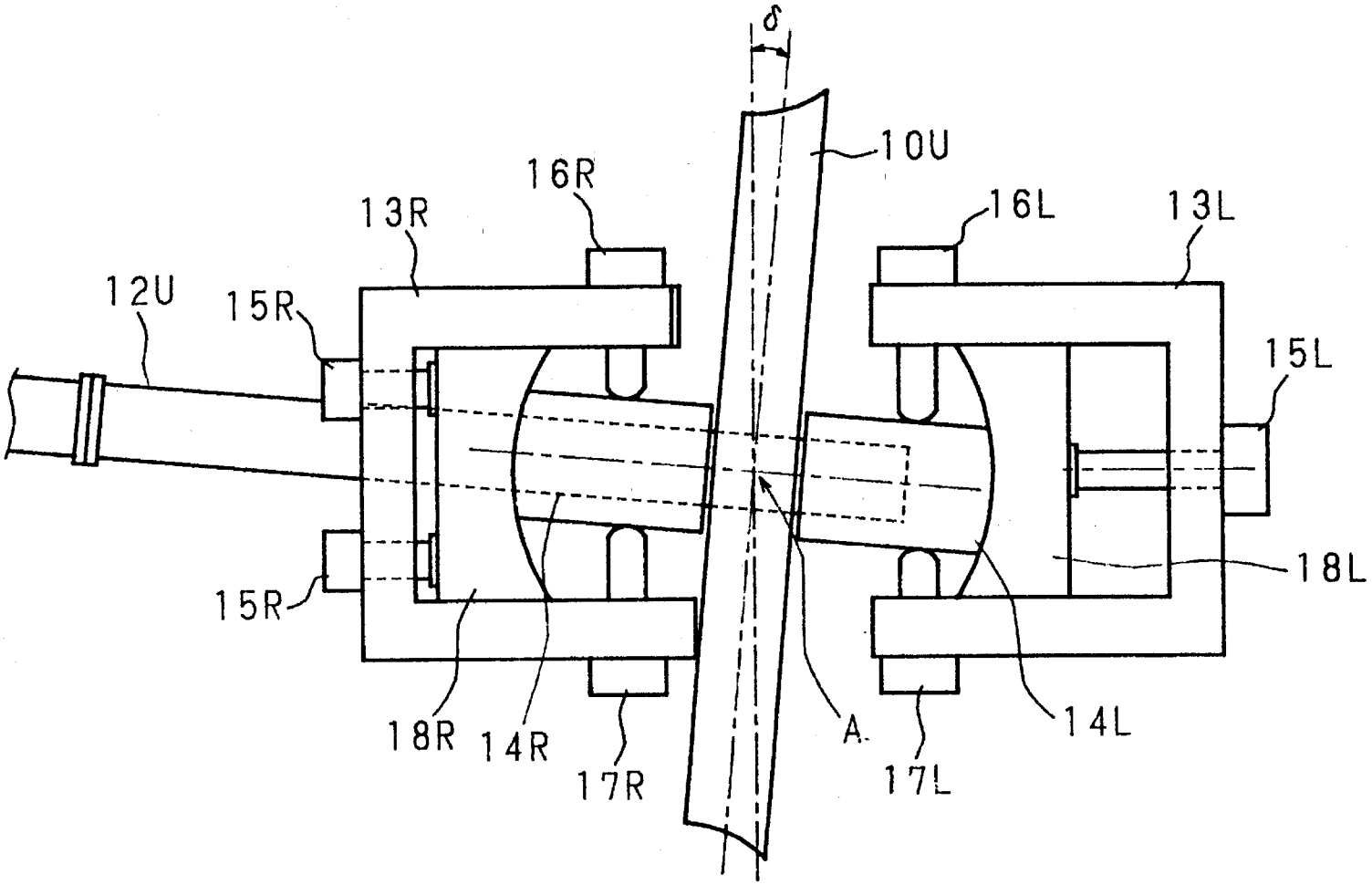
FIG. 10 is a plan view showing a mechanism for giving a skew angle of disk roll.

FIG. 10 is a plan view of a mechanism capable of giving the skew angle δ of a desired value with the screw method. The vertical direction in the drawing is the direction of the pass line. The upper part is the inlet side of rolling and the lower part is the outlet side of rolling. In FIG. 10, 13R and 13L denote casings for the disk roll 10U, within which chocks 14R, 14L each having a lace in the form of a spherical seat are supported on spherical seat supporting tables 18R, 18L. Passing through the chocks 14R, 14L is the disk roll shaft 12U. Provided within the casings 13R, 13L are screws 16R, 16L, 17R, 17L for setting a skew angle, and their traveling direction is the same as the direction of the pass line. The respective tips of the screws 16R, 16L, 17R, 17L are in contact with the chocks 14R, 14L. There are also disposed, within the casings 13R, 13L, screws 15R, 15L for adjusting the right-to-left position of the disk roll 10U, in such a manner that the tips of them are in contact with the spherical seat supporting tables 18R, 18L. The positions of the screws 16R, 16L, 17R, 17L can be adjusted manually or non-manually, thereby giving the skew angle of a desired value the vertex of which is the center A of the disk roll 10U.

Figure 11:
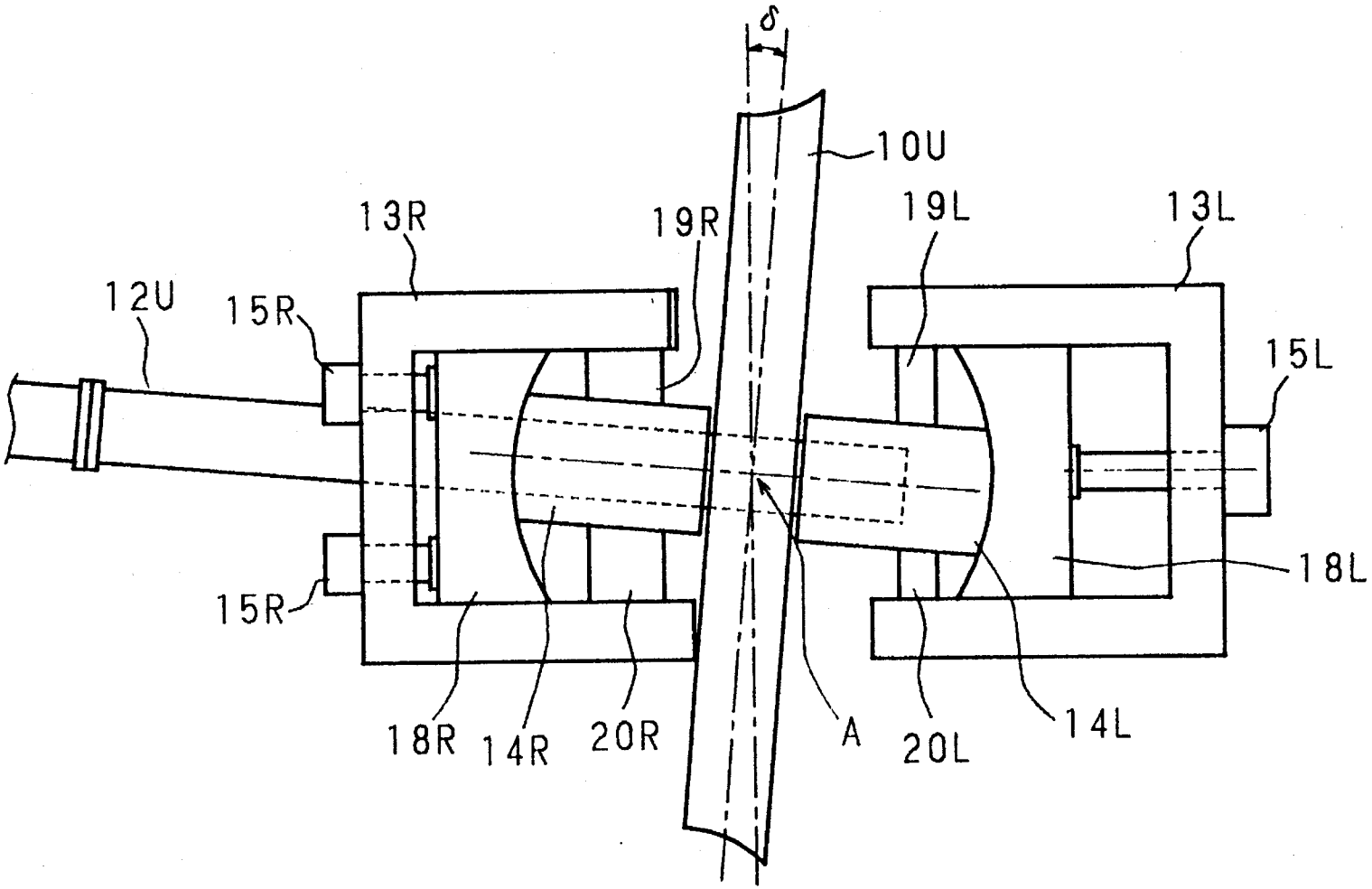
FIG. 11 is a plan view showing another mechanism for giving a skew angle of disk roll.

FIG. 11 is a plan view showing a mechanism for giving the skew angle δ of desired value with the liner exchange method. In FIG. 11, the parts indicated by the same reference numerals as used for those in FIG. 10 have the same functions as those of the latter. There are provided liners 19R, 19L, 20R, 20L for setting a skew angle, being fitted between the chocks 14R, 14L and the inner walls of the casings 13R, 13L. The plurality of pairs of liners having different face configurations (angular configurations) are thus prepared and either pair is selectively used, whereby the skew angle δ the value of which is arbitrarily determined to some extent can be given to the disk roll 10U.

Figure 12:
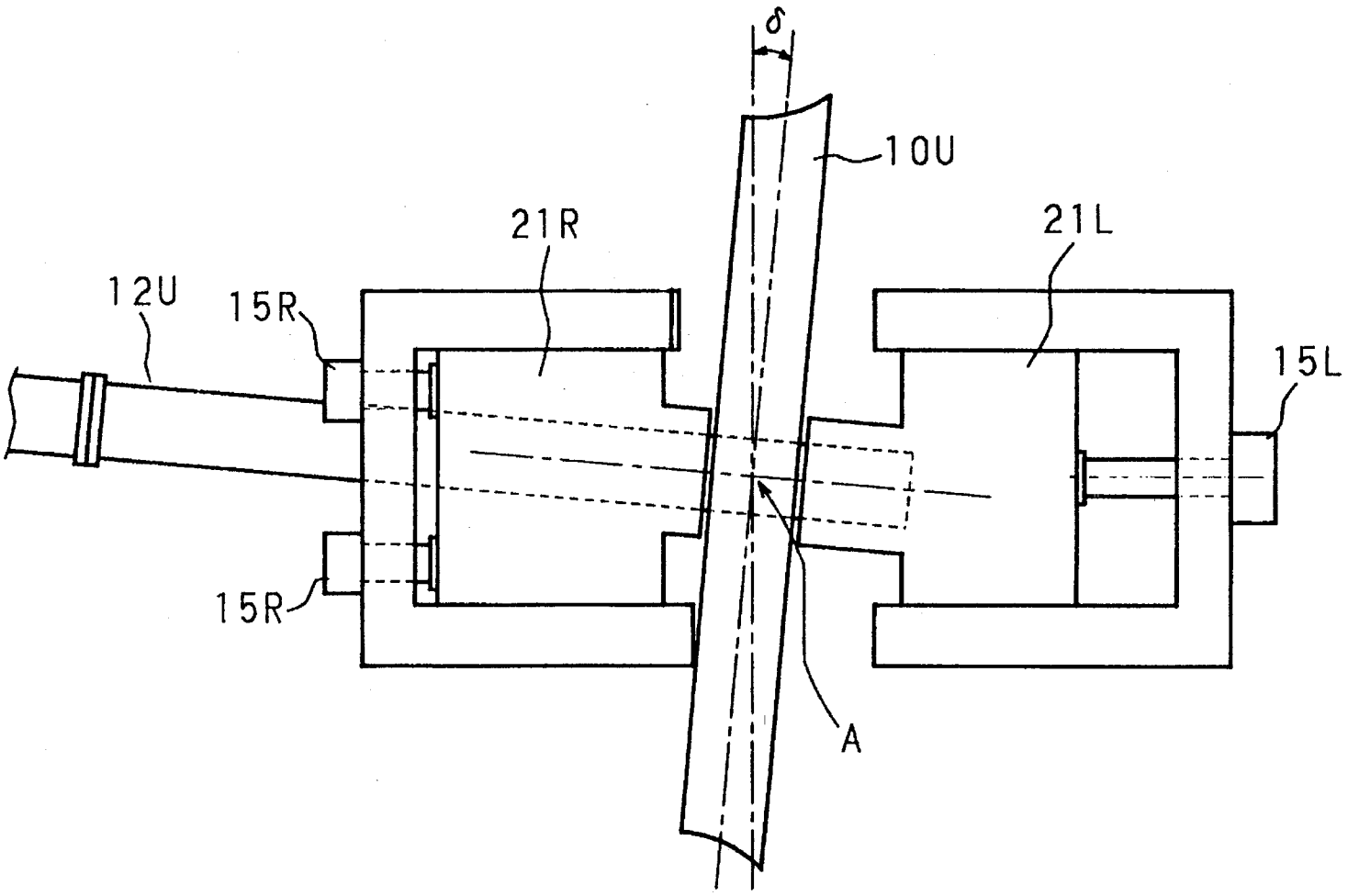
FIG. 12 is a plan view showing still another mechanism for giving a skew angle of disk roll.

FIG. 12 is a plan view of a mechanism for giving the fixed skew angle δ with the fixed method. In FIG. 12, the parts indicated by the same reference numerals as used for those in FIG. 10 have the same functions as the latter. Chocks 21R, 21L of a specified shape are securely fitted within the casings 13R, 13L. In this case, the fixed skew angle δ is given to the disk roll 10U.

The degree of freedom for setting the skew angle δ is the highest in the screw method shown in FIG. 10, and the lowest in the fixed method shown in FIG. 12. The medium degree of freedom is obtainable in the liner exchange method shown in FIG. 11. One of the mechanisms for giving the skew angle δ to the disk rolls may be arbitrarily selected or alternatively, a plurality of mechanisms selected from those may be used in combination.

Figure 13:
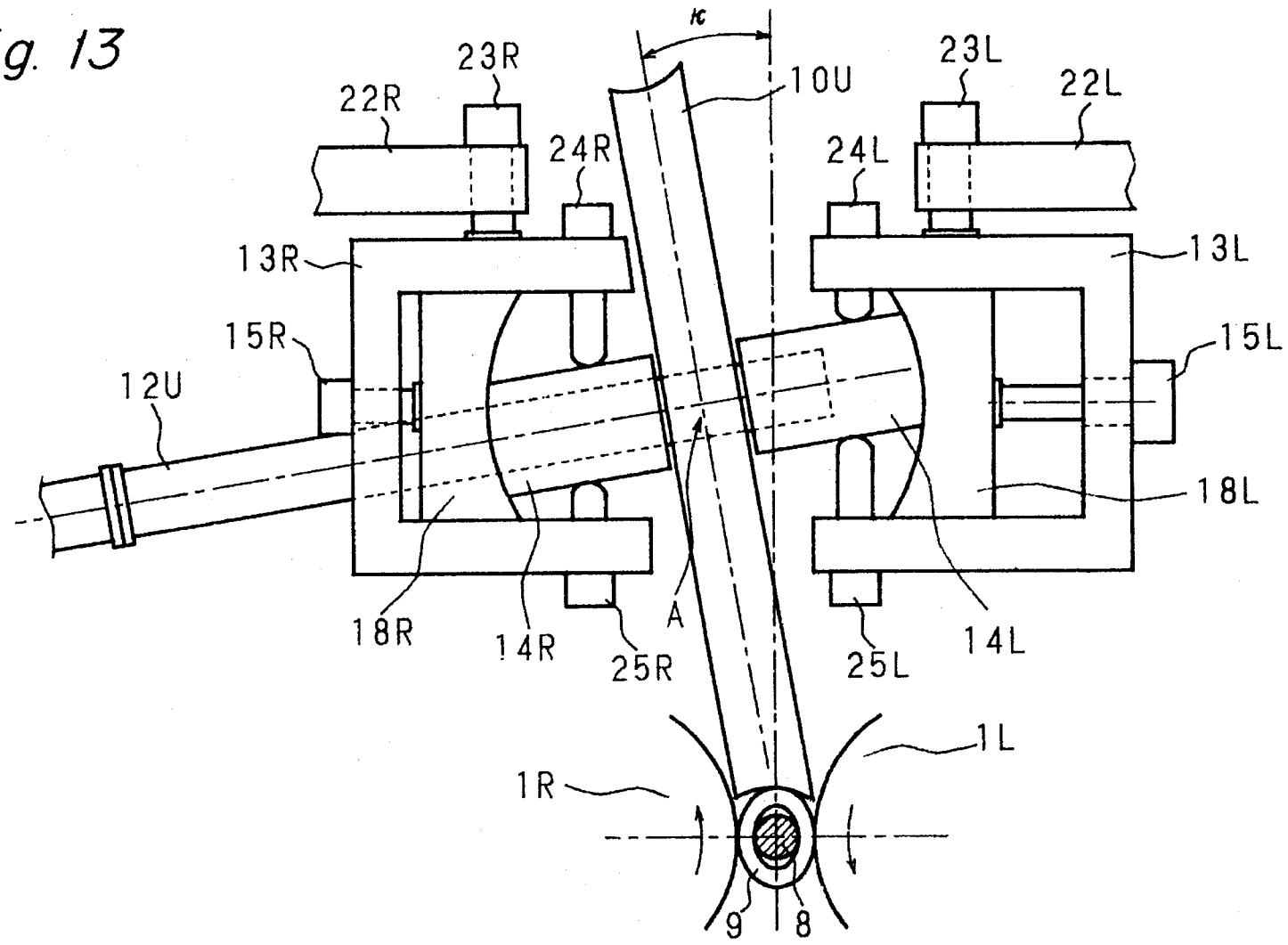
FIG. 13 is an elevation of a mechanism for giving an inclination angle of disk roll, when viewing from the outlet side of rolling.

FIG. 13 is an elevation of a mechanism for giving the inclination angle κ of a desired value with the screw method, when viewing from the outlet side of rolling. The direction of the pass line corresponds to a direction orthogonal to the plane of the drawing. The front side of the plane is the outlet side of rolling and the rear side of it is the inlet side of rolling. In FIG. 13, the parts indicated by the same reference numerals as used for those in FIG. 10 are substantially identical to the latter. 22R and 22L denote housings within which screws 23R, 23L for adjusting the opening of the disk roll 10U are so disposed as to be in contact with the casings 13R, 13L. Provided within the casings 13R, 13L are screws 24R, 24L, 25R, 25L for setting the inclination angle. Those screws 24R, 24L, 25R, 25L are disposed in such a manner that their traveling direction is vertical and their tips are in contact with the chocks 14R, 14L. The positions of the screws 24R, 24L, 25R, 25L are manually or non-manually adjusted, thereby giving the inclination angle κ of a desired value to the disk roll 10U.

Figure 14:
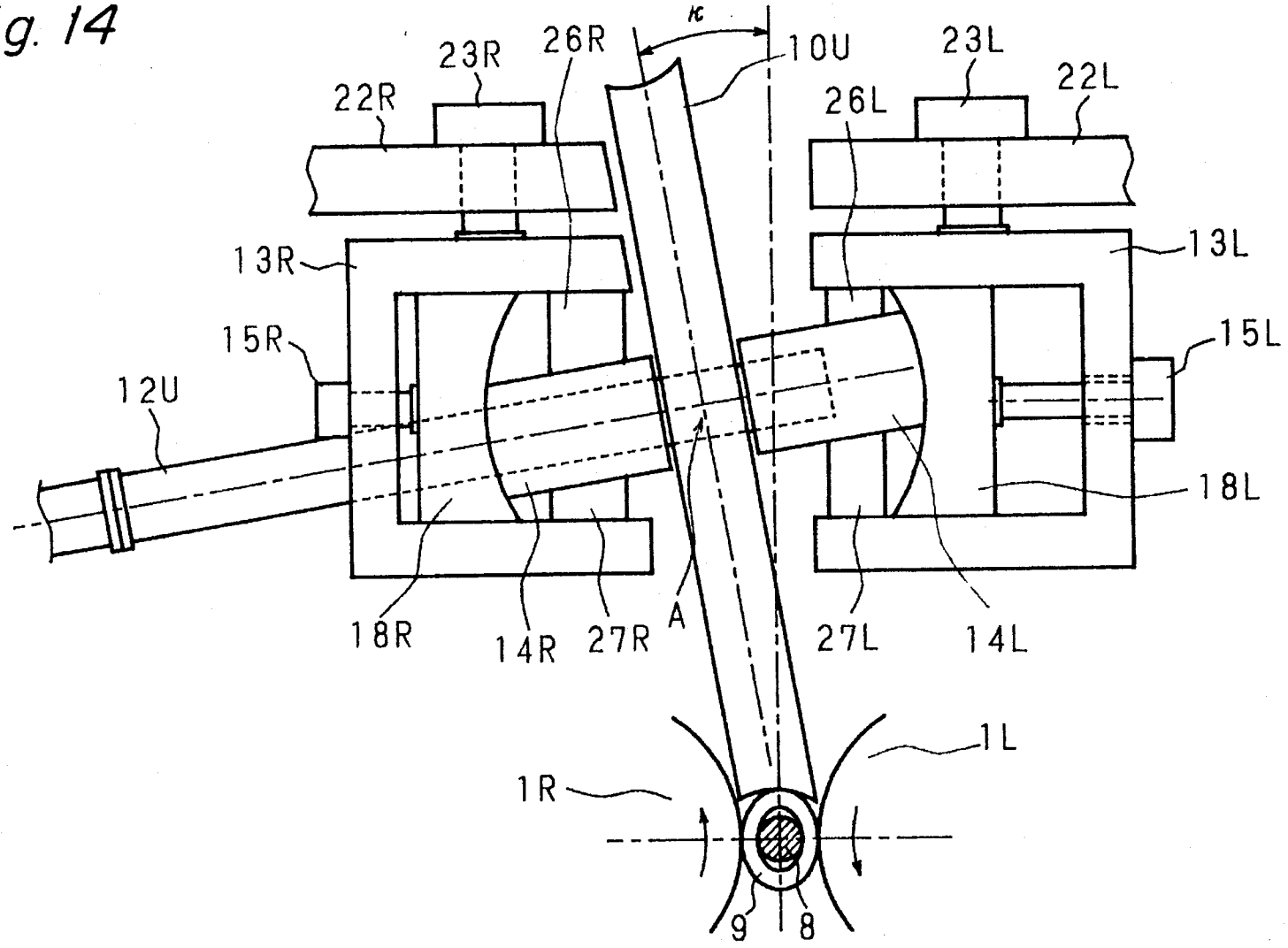
FIG. 14 is an elevation of another mechanism for giving an inclination angle of disk roll, when viewing from the outlet side of rolling.

FIG. 14 is an elevation of a mechanism for giving the inclination angle κ of a desired value with the liner exchange method, when viewing from the outlet side of rolling. In FIG. 14, the parts indicated by the same reference numerals as used for those in FIG. 13 are substantially identical to the latter. Liners 26R, 26L, 27R, 27L for setting an inclination angle are fitted between the chocks 14R, 14L and the inner walls of the casings 13R, 13L. Similarly to the case shown in FIG. 11, one pair of liners is used being selected from the above plurality of pairs, whereby the inclination angle κ of a desired value can be given to the disk roll 10U.

Figure 15:
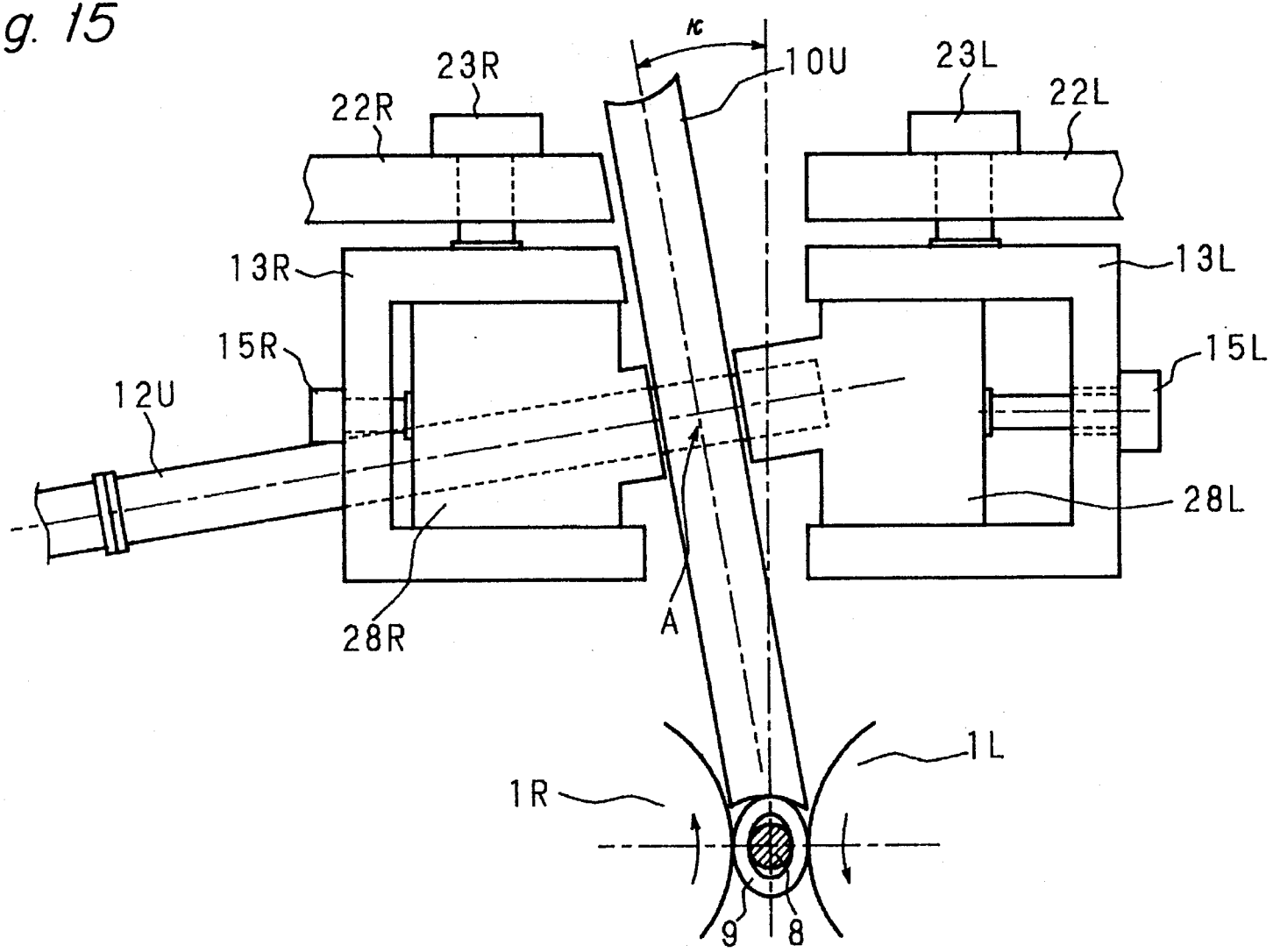
FIG. 15 is an elevation of still another mechanism for giving an inclination angle of disk roll, when viewing from the outlet side of rolling.

FIG. 15 is an elevation of a mechanism for giving the fixed inclination angle κ with the fixed method, when viewing from the outlet side of rolling. In FIG. 15, the parts indicated by the same reference numerals as used for those in FIG. 13 are substantially identical to the latter. Chocks 28R, 28L of a specified shape are firmly fitted in the casings 13R, 13L. In this case, the fixed inclination angle κ is given to the disk roll 10U.

Like the skew angle δ, the degree of freedom for setting the inclination angle κ in the screw method (FIG. 13) is the highest, with the liner exchange method (FIG. 14) and the fixed method (FIG. 15) following in that order. A desired mechanism may be selected from those in accordance with situations, or alternatively a plurality of mechanisms may be used in combination.

The skew angle δ and the inclination angle κ are given to the disk rolls by,the use of the above-described mechanisms, whereby the positional arrangement of the piercing rolls and the disk rolls as shown in FIG. 7 becomes feasible. As to the inclination of the disk rolls, the positional relation with the piercing rolls is only a significant matter, so that the arrangement shown in FIG. 7 can be also achieved by giving a feed angle κ' to the piercing rolls whereas the disk rolls are not inclined and giving the skew angle δ to the disk rolls.

Figure 16:
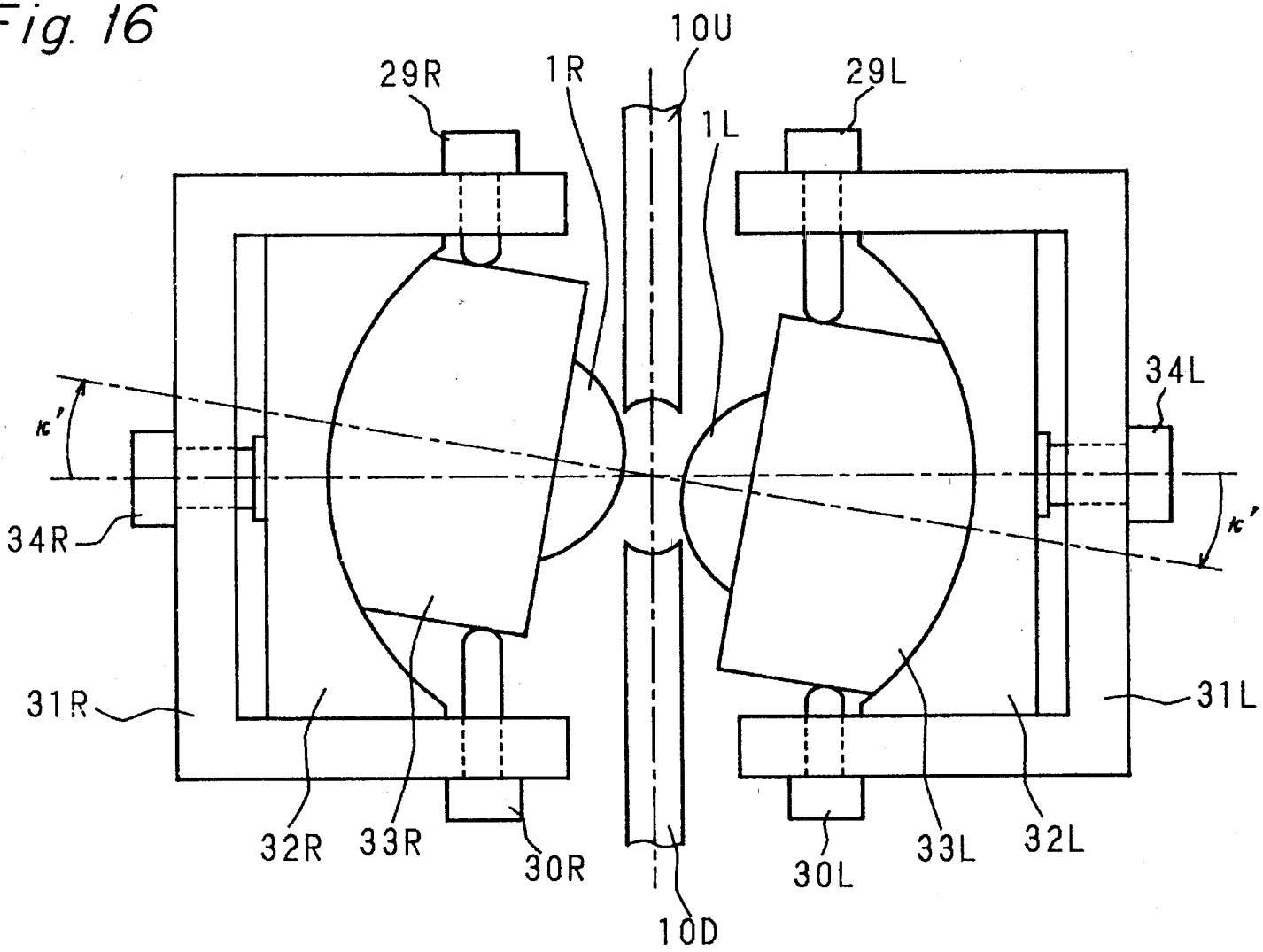
FIG. 16 is an elevation of a mechanism for giving a feed angle of piercing roll, when viewing from the outlet side of rolling.

FIG. 16 is an elevation of a mechanism for giving the feed angle κ' of a desired value to the piercing rolls with the screw method, when viewing from the outlet side of rolling. The direction orthogonal to the plane of the drawing is the direction of the pass line, and the front side of the plane is the outlet side of rolling and the rear side of the plane is the inlet side of rolling. In FIG. 16, 31R and 31L denote cradles for the piercing rolls 1R, 1L. Within the cradles 31R, 31L, yokes 33R, 33L are supported by spherical seat supporting tables 32R, 32L, either face of the respective yokes 33R, 33L being a spherical seat. The cradles 31R, 31L are provided with screws 29R, 29L, 30R, 30L for setting a feed angle which are so disposed that their traveling direction is a vertical direction and their tips are in contact with the yokes 33R, 33L. Also, the cradles 31R, 31L are provided with screws 34R, 34L for adjusting the openings of the piercing rolls 1R, 1L, the tips of the screws 34R, 34L being in contact with the spherical seat supporting tables 32R,32L. The positions of the screws 29R, 29L, 30R, 30L are manually or non-manually adjusted, thereby giving the feed angle κ' of a desired value to the piercing rolls 1R, 1L.

Apart from the above mechanism adopting the screw method, other mechanisms, i.e., the mechanism adopting the liner exchange method as shown in FIGS. 11 and 14, or the mechanism adopting the fixed method as shown in FIGS. 12 and 15 may be selectively used for giving the feed angle κ' to the piercing rolls 1R, 1L. It is also possible to use a plurality of mechanisms selected from them in combination.

The above-described arrangement of the disk rolls and the piercing rolls allows the gaps between the piercing rolls and the disk rolls to be narrower, thereby preventing the bulged-out metal of the pierced shell from being entrapped into the gap. As the skew angle of disk roll and the inclination angle of disk roll κ are increased, the gaps will be narrower. However, it is also true that since the piercing rolls are in the form of a cone, those angles cannot be set more than their respective angle limits (i.e., a maximum skew angle of disk roll $\delta_m$ m and a maximum inclination angle of disk roll $\kappa_m$) beyond which the side faces of the disk rolls come in contact with the side rolling surface of the piercing rolls.

One solution to make the side faces of the disk rolls avoid the contact with the expanded portions of the piercing rolls would be the provision of a circular groove formed on the periphery of a side face of each disk roll. Such a proposal is disclosed in another embodiment of the present invention. The following is a description of this embodiment.

The size of the circular groove to be formed is dependent on the magnitude of indentation of the side face of the disk roll into the piercing roll. This magnitude of indentation, however, varies according to the inclination of the disk roll, namely, the skew angle of disk roll δ and the inclination angle of disk roll κ. Here, various gap distances and various magnitudes of the contact of the side face of the disk roll with the piercing roll, those variations being caused by changes in the inclination of the disk roll, will be explained in detail.

Figure 17:
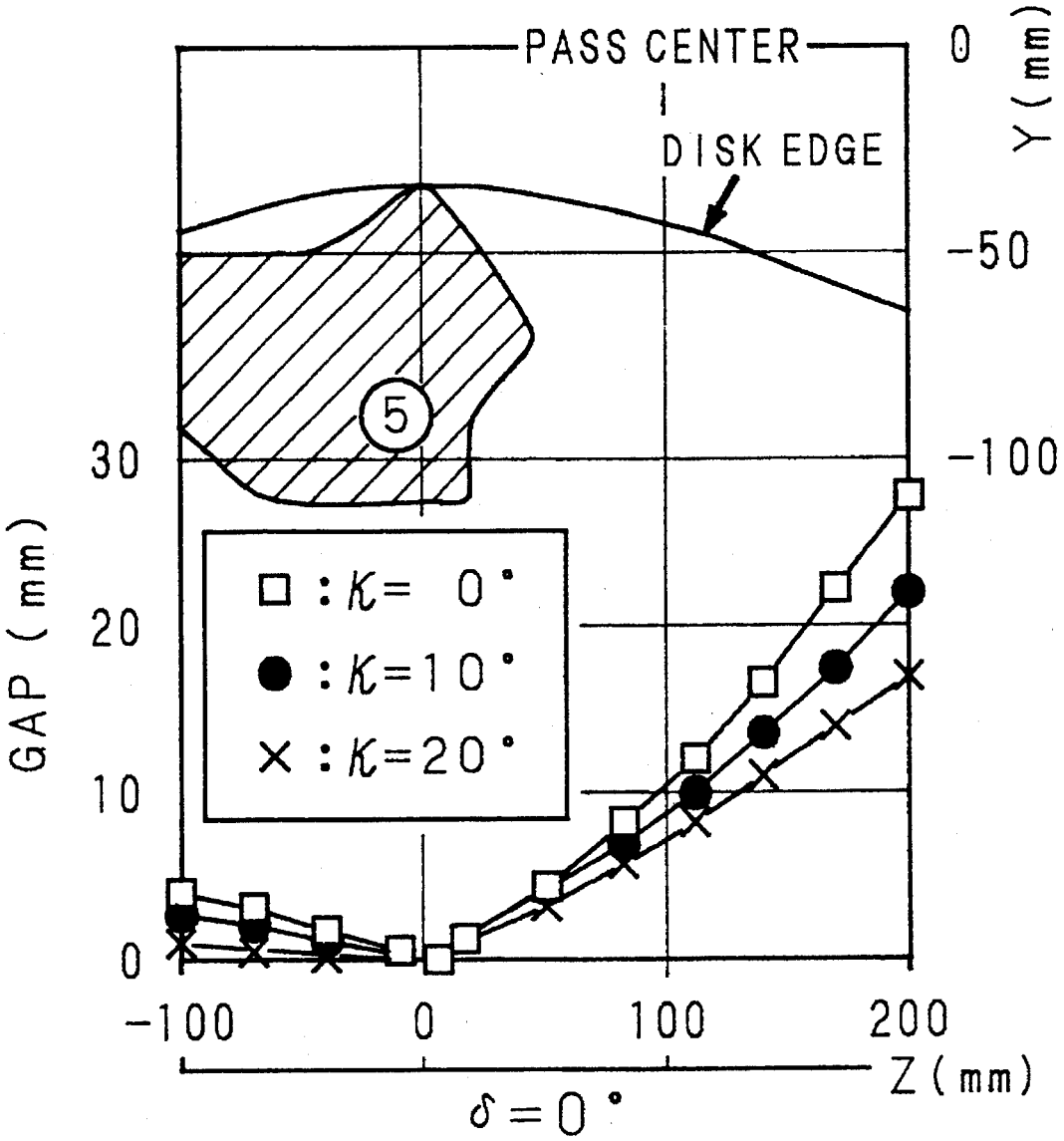
FIG. 17 diagrammatically illustrates the length of a gap and the magnitude of indentation of a side face of the disk roll into the piercing roll, in the case where the skew angle of disk roll δ is 0°.
Figure 18:
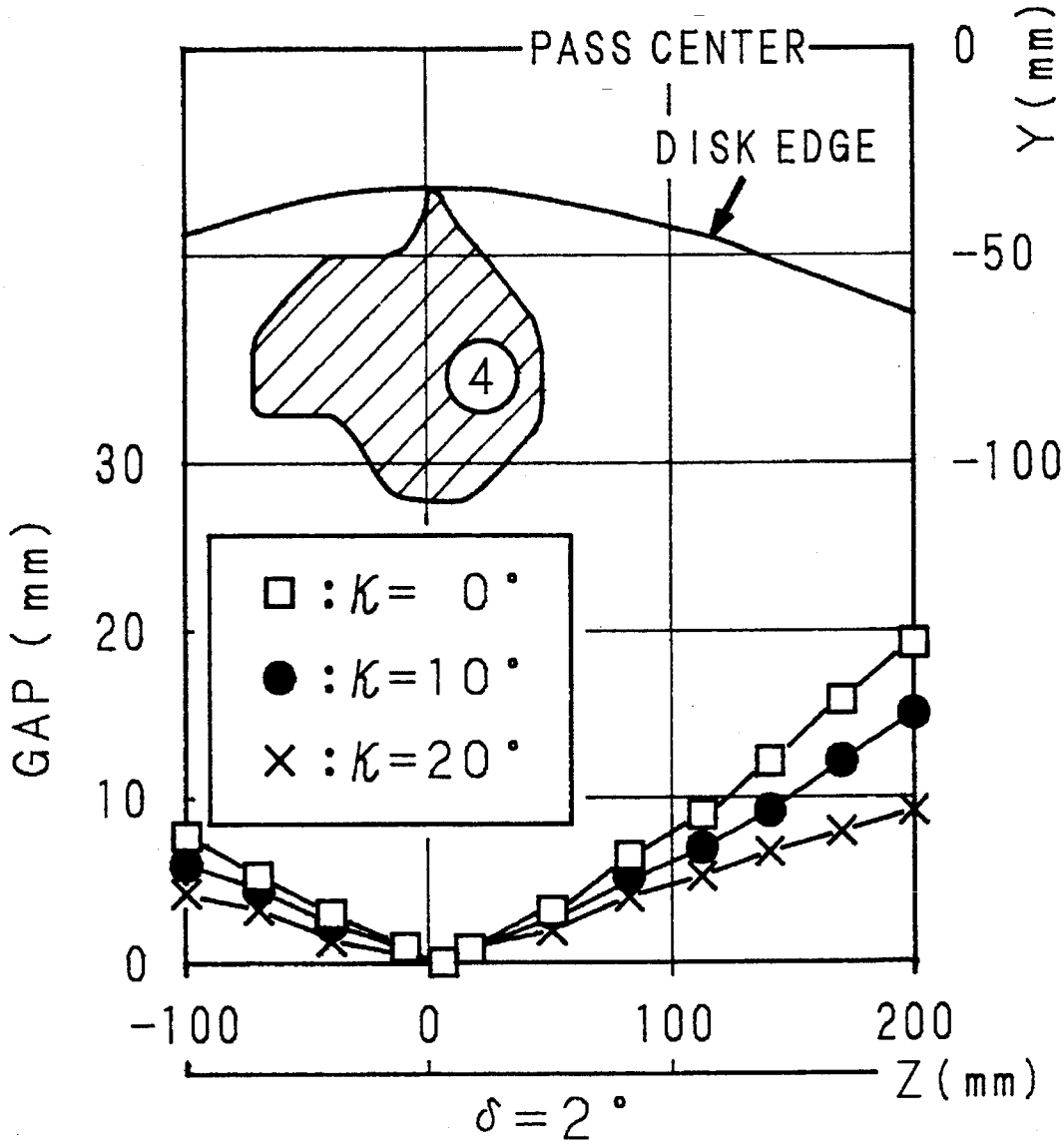
FIG. 18 diagrammatically illustrates the length of a gap and the magnitude of indentation of a side face of the disk roll into the piercing roll in the case where the skew angle of disk roll δ is 2°.

First, the parameters for the piercing roll and the disk roll were set as follows. The piercing roll having an outlet face angle α of 4° and a gorge diameter of 410 mm was disposed with a gorge spacing of 62 mm, a cross angle γ of 30° and a feed angle β of 12°, while the disk roll having an edge diameter of 1,200 mm was spaced with a disk edge spacing of 70 mm. In such a condition, the skew angle of disk roll δ was varied to 0°, 2°, 4° and 6° and the inclination angle of disk roll κ was varied to 0°, 10° and 20° . In each case, the length of the gap between the piercing roll and the disk roll measured from the gorge portion of the piercing roll as well as the magnitude of indentation of the side face of the disk roll into the piercing roll was calculated. Those results are shown in FIGS. 17 through 20. FIG. 17 diagrammatically explains the case where the skew angle of disk roll δ=0°, FIG. 18 explains the case where the skew angle of disk roll δ=2°, FIG. 19 explains the case where the skew angle of disk roll δ=4° and FIG. 20 explains the case where the skew angle of disk roll δ=6°. In each case, the length of the gap and the magnitude of indentation of the side face of the disk roll with the piercing roll are calculated with the inclination angle of disk roll 78 being varied to 0° and 20°.

Figure 21:
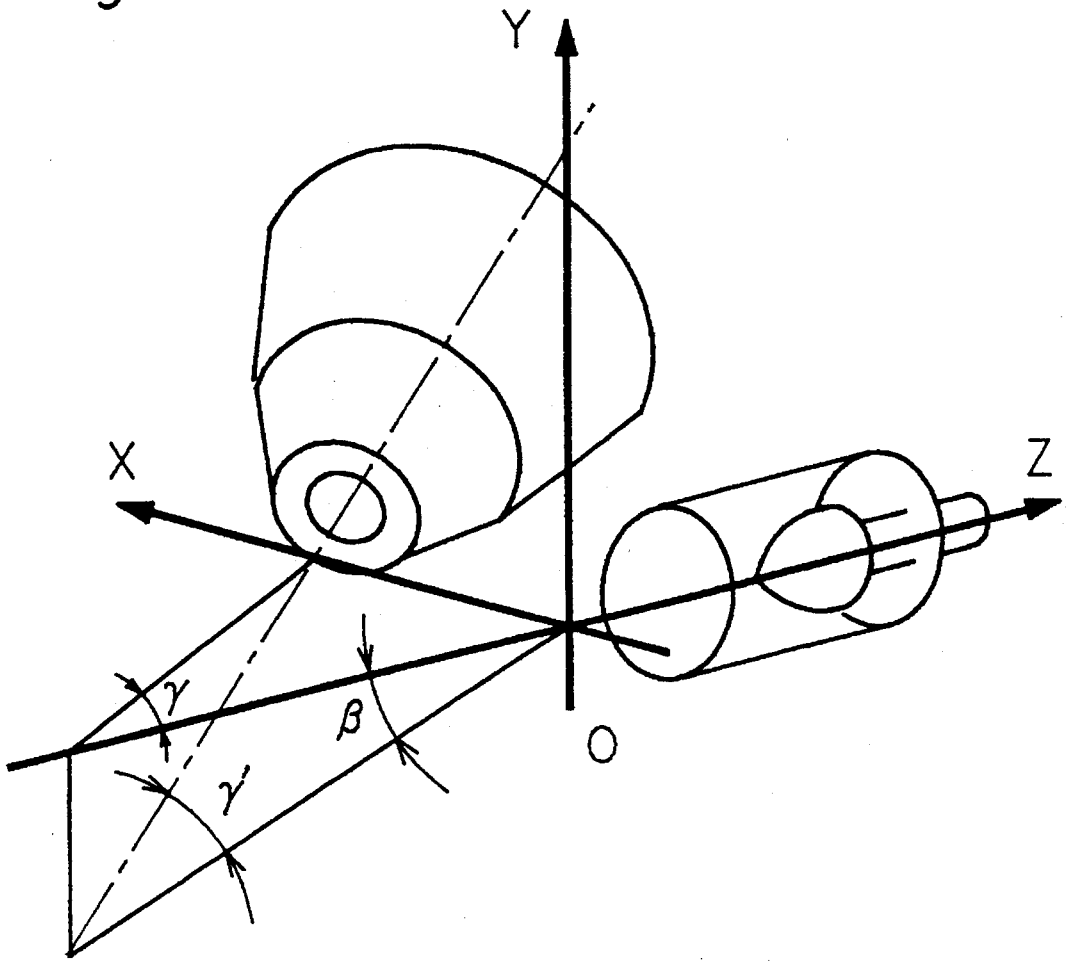
FIG. 21 is a diagram illustrating the arrangement of the piercing roll and the disk roll, using coordinates.

FIG. 21 is a diagram illustrating the arrangement of the piercing roll and the disk roll, using an orthogonal coordinate system. In the coordinates, the piercing point by the gorge portion of the piercing roll is represented by the origin, although the origin in FIG. 21 is illustrated differently from this definition for the convenience of illustration, the direction towards the center of the gorge portion of the piercing roll by the X-axis, the perpendicular direction by the Y-axis, and the direction of the pass center by the Z-axis. Another piercing roll symmetrically disposed to the above piercing roll is located in the plane in the negative direction of the Y-axis. The piercing direction corresponds to the positive direction of the Z-axis.

The graphs of FIGS. 17 through 20 show the value of the gap between the piercing roll and the disk roll in the rolling direction. Symbol □ denotes the case where the inclination angle of disk roll κ=0°, symbol ● denotes the case where the inclination angle of disk roll κ=10°, symbol X denotes the case where the inclination angle of disk roll κ=20°. In the case shown in FIG. 14, when the skew angle of disk roll δ=6° and the inclination angle of disk roll κ=20°, the length of the gap has a negative value. This indicates that the edge of the disk roll is in contact with the piercing roll.

The side face of the disk roll comes into contact with the piercing roll only when the inclination angle of disk roll κ=20°. In each of FIGS. 17 through 20, the hatched part indicates the contact area of the side face of the disk roll with the piercing roll when the inclination angle of disk roll κ=20° and the abscissa represents the rolling direction while the ordinate represents the perpendicular direction. Symbol ○ denotes a position at where the amount of indentation has a maximum depth, and the numeric value in the symbol ○ is the maximum depth of indentation. The position of the disk edge is plotted in the same coordinates.

In the above setting examples of the skew angle of disk roll δ and the inclination angle of disk roll κ, one of the most effective settling examples for narrowing the gaps to prevent the peeling phenomena from occurring is the case where δ=4° and κ=20°. From the magnitude of the contact of the side face of the disk roll with the piercing roll when δ=4° and κ=20° the size of the circular groove to be formed in the periphery of the side face of the disk roll, the side face being on the side of the piercing roll, is obtained.

Figure 22:
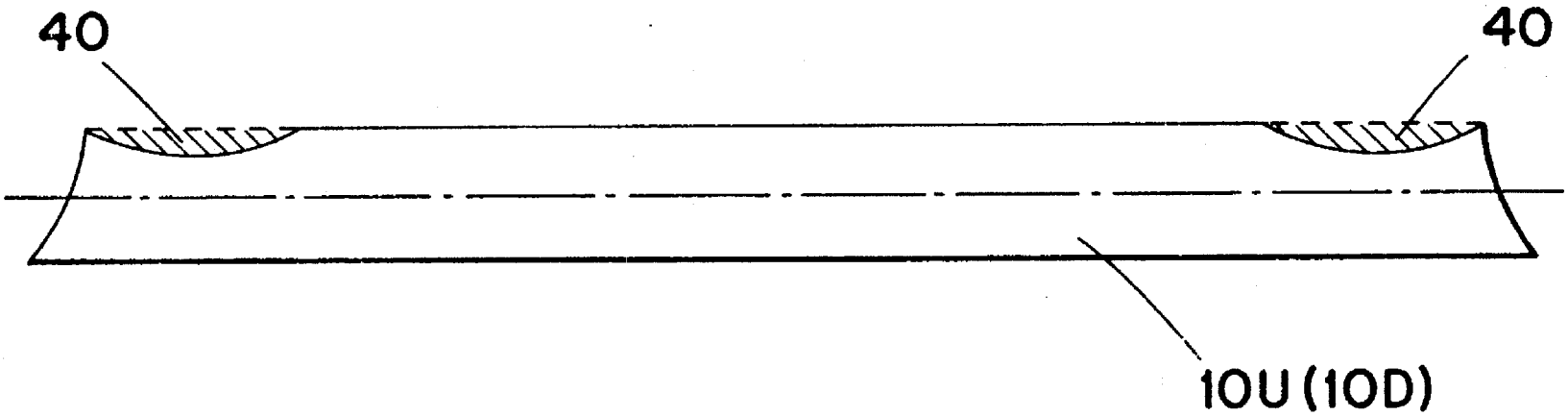
FIG. 22 is a cross section of a disk roll according to another embodiment of the present invention.

FIG. 22 is a cross section of the disk roll 10U(10D) according to another embodiment. The hatched part represents a circular groove 40. The side face of the disk roll 10U(10D) is circular and has edge diameters of 1,200 mm and 1,240 mm. The thickness, i.e., the distance between the two side faces is 55 mm. The periphery of the side face of smaller diameter (i.e., 1,200 mm) is provided with the circular groove 40 having a width of 100 mm (the groove extends by 100 mm from the edge towards the center of the side face). The groove 40 has a maximum depth of 6 mm and its bottom takes the form of a circle.

Figure 19:
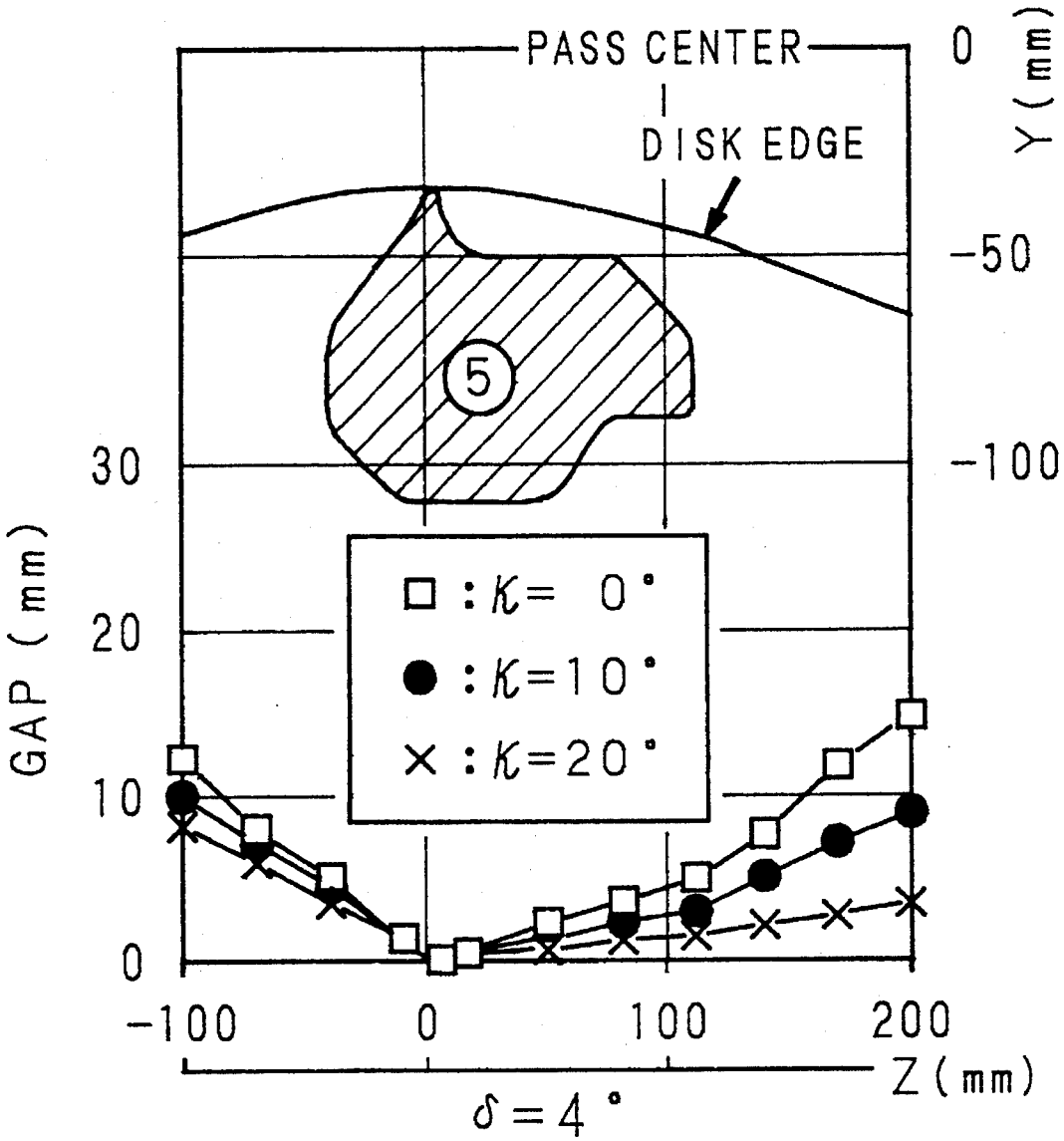
FIG. 19 diagrammatically illustrates the length of a gap and the magnitude of indentation of a side face of the disk roll into the piercing roll in the case where the skew angle of disk roll δ is 4°.
Figure 20:
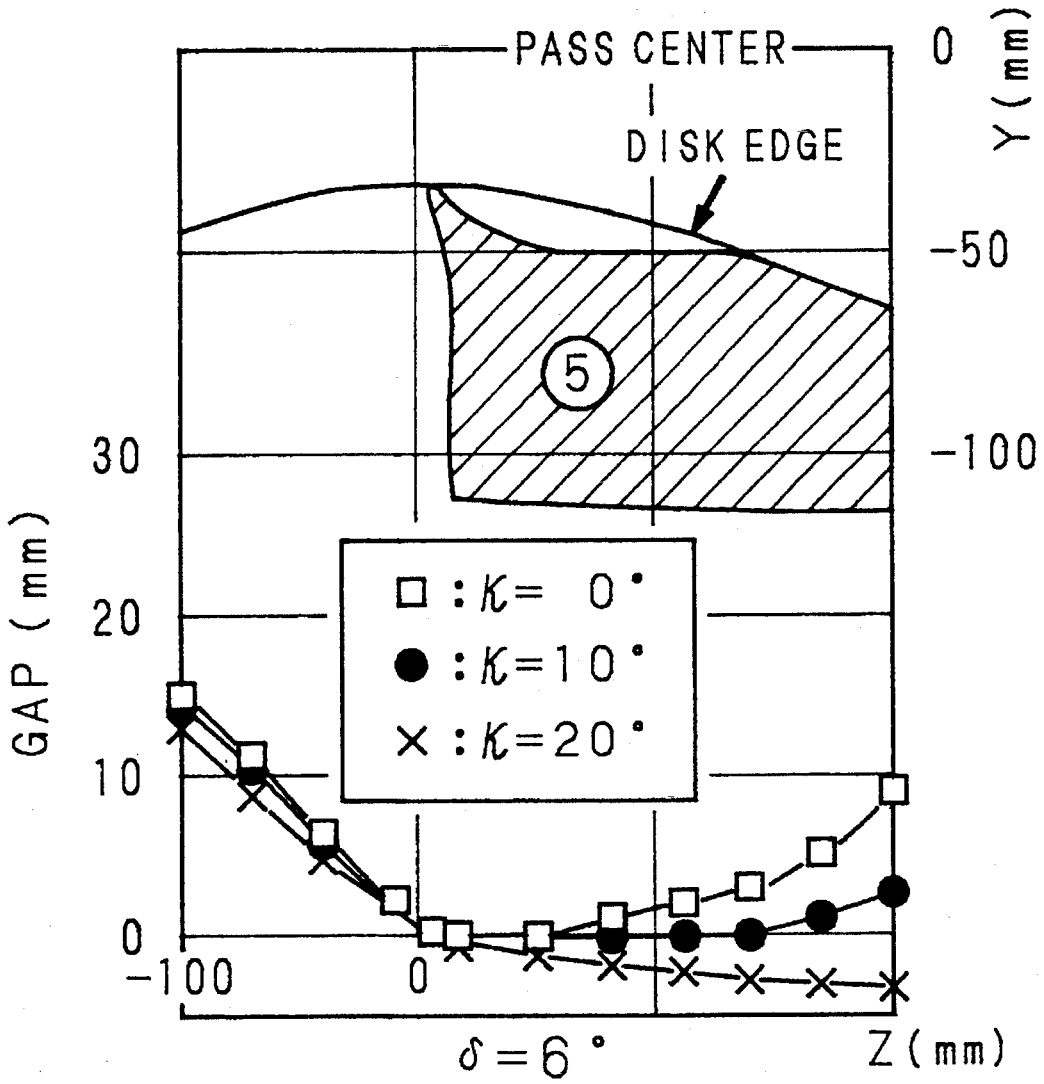
FIG. 20 diagrammatically illustrates the length of a gap and the magnitude of indentation of a side face of the disk roll into the piercing roll in the case where the skew angle of disk roll δ is 6°.

As shown in FIG. 19, when the skew angle of disk roll δ=4° and the inclination angle of disk roll κ=20°, the location and amount of indentation is a distance of about 75 mm from the pass center in the perpendicular direction. In the case of the actual disk roll surface, this corresponds to a distance of about 80 mm from the pass center in the perpendicular direction. The maximum depth of indentation is 5 mm. It is understood from the above facts that the circular groove 40 of the above-described embodiment is formed at a position where the contact with the piercing roll takes place and has a size large enough to accommodate the indentation amount.

Using the disk rolls each having the above circular groove in the inclined conditions as described above, a carbon-steel billet with a diameter of 70 mm was rolled and pierced so as to have an outer diameter of 72 mm and a wall thickness of 2 mm. With such an inclined-rolling apparatus, the gap exceeded 2 mm at a position 140 mm apart from the gorge portion of the piercing roll in the rolling direction so that the rolling/piercing operation was performed without the occurrence of the peeling phenomena. On the other hand, using a conventional inclined-rolling apparatus with the skew angle of disk roll $\delta=4°$ and the inclination angle of disk roll $\kappa=10°$, the same rolling/piercing operation was effected. The gap exceeded 2 mm at a position 75 mm apart from the gorge portion of the piercing roll in the rolling direction and the peeling phenomena occurred at the position of 80 mm. It is appreciated from the above tests that the provision of the circular groove 40 is able to further narrow the gaps so that rolling/piercing can be performed without occurring the entrapping of the pierced shell into those gaps.

This embodiment is also effective when wide tube piercing operation is effected, in which the ratio of outer diameter after the piercing operation to outer diameter before the operation is 1.3 1.5, 2.0 etc.

Although a horizontal type piercer has been described, the invention is not necessarily limited to the particular apparatus shown herein and the alternatives to the horizontal type may be vertical type piercers or rolling apparatus of their combination.

A rolling/piercing apparatus for billets has been described hereinabove, but it is also possible to apply the invention to a drawing/rolling apparatus for elongating hollow shells.

Further, the description has been made taking cone type piercing rolls for example, but other types such as the barrel type may be used as far as the piercing rolls have an inlet face angle and an outlet face angle with respect to the pass line.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An inclined-rolling method for piercing a tube material traveling along a pass line or enlarging the diameter thereof by the use of a pair of conical piercing rolls and a pair of disk rolls, comprising the steps of:

positioning said conical piercing rolls and said disk rolls in such a manner that images of shaft center lines of said respective disk rolls projected on the plane including roll shaft centers of said conical piercing rolls to which no feed angle is given are at an angle other than 90° to the pass line and the shaft center lines intersect said plane;

positioning said conical piercing rolls in such a manner that said roll shaft centers of said conical piercing rolls are at a feed angle; and rolling the tube material with said conical piercing rolls and said disk rolls positioned in said manner.

2. An inclined-rolling method according to claim 1, wherein the projection images of the shaft center lines of said disk rolls are arranged so as to be at an angle other than 90° to the pass line and the shaft center lines intersect said plane, in such a direction that a gap between an outlet face of each of said conical piercing rolls and an edge of each of said disk rolls is narrowed, the edge being on the side at which the tube material revolves and proceeds at the outlet faces of said conical piercing rolls.

3. An inclined-rolling method according to claim 2, wherein the angle between each of the projection images of the shaft center lines of said disk rolls and the pass line is 1.5 times an outlet face angle of said conical piercing rolls to which no feed angle is given.

4. An inclined-rolling method according to claim 2, wherein the angle between each of the shaft center lines of said disk rolls and said plane is not more than 20° degrees.

5. An inclined-rolling method according to claim 1, wherein said shaft center lines of said disk rolls lie in planes which are not parallel to the pass line.

6. An inclined-rolling method according to claim 1, wherein each of said disk rolls includes an outer circumferential face which is concave in shape and the circumferential face has opposed edges with different diameters.

7. An inclined-rolling apparatus for piercing a tube material traveling along a pass line or enlarging the diameter thereof by the use of a pair of conical piercing rolls and a pair of disk rolls, wherein said conical piercing rolls and said disk rolls are positioned in such a manner that images of shaft center lines of said respective disk rolls projected on the plane including roll shaft centers of said conical piercing rolls to which no feed angle is given are at an angle other than 90° to the pass line and the shaft center lines intersect said plane, said apparatus including means for positioning said conical piercing rolls in such a manner that said roll shaft centers of said conical piercing rolls are at a feed angle.

8. An inclined-rolling apparatus according to claim 7, wherein said shaft center lines of said disk rolls lie in planes which are not parallel to the pass line.

9. An inclined-rolling apparatus according to claim 7, wherein each of said disk rolls includes an outer circumferential face which is concave in shape and the circumferential face has opposed edges with different diameters.

10. An inclined-rolling apparatus for piercing a tube material traveling along a pass line or enlarging the diameter thereof, comprising:

a pair of conical piercing rolls disposed with the pass line therebetween;

a pair of disk rolls disposed with the pass line therebetween;

means for rotating said disk rolls on planes parallel to the plane including roll shaft centers of said conical piercing rolls to which no feed angle is given;

means for inclining said disk rolls such that shaft center lines of said disk rolls intersect said plane including the roll shafts of said conical piercing rolls and the conical piercing rolls and the disk rolls are positioned in such a manner that images of shaft center lines of the respective disk rolls projected on the plane including roll shaft centers of the conical piercing rolls to which no feed angle is given are at an angle other than 90° to the pass line and said shaft center lines intersect said plane; and means for positioning said conical piercing rolls in such a manner that said roll shaft centers of said conical piercing rolls are at a feed angle.

11. An inclined-rolling apparatus according to claim 10, wherein the periphery of a side face of each of said disk rolls is provided with a circular groove.

12. An inclined-rolling apparatus according to claim 10, wherein said shaft center lines of said disk rolls lie in planes which are not parallel to the pass line.

13. An inclined-rolling apparatus according to claim 11, wherein the circular groove is sized to avoid contact with a portion of a respective one of the conical piercing rolls when the disk rolls are at a maximum inclination angle.

14. An inclined-rolling apparatus for piercing a tube material traveling along a pass line or enlarging the diameter thereof, comprising:

a pair of conical piercing rolls disposed with the pass line therebetween;

a pair of disk rolls disposed with the pass line therebetween;

means for rotating said disk rolls on planes parallel to the plane including roll shaft centers of said conical piercing rolls to which no feed angle is given;

means for rotating a rolling system except said disk rolls such that shaft center lines of said disk rolls intersect said plane including the roll shafts of said conical piercing rolls and the disk rolls are positioned in such a manner that images of shaft center lines of the respective disk rolls projected on the plane including roll shaft centers of the conical piercing rolls to which no feed angle is given are at an angle other than 90° to the pass line and said shaft center lines intersect said plane; and means for positioning said conical piercing rolls in such a manner that said roll shaft centers of said conical piercing rolls are at a feed angle.

15. An inclined-rolling apparatus according to claim 14, wherein the periphery of a side face of each of said disk rolls is provided with a circular groove.

16. An inclined-rolling apparatus according to claim 15, wherein the circular groove is sized to avoid contact with a portion of a respective one of the conical piercing rolls when the disk rolls are at a maximum inclination angle.

17. An inclined-rolling apparatus according to claim 14, wherein said shaft center lines of said disk rolls lie in planes which are not parallel to the pass line.

* * * * *